United States Patent [19]

Katayama et al.

[11] Patent Number: 4,565,574

[45] Date of Patent: Jan. 21, 1986

[54] PROCESS FOR PRODUCTION OF HIGH-CHROMIUM ALLOY BY SMELTING REDUCTION

[75] Inventors: Hiroyuki Katayama; Hidetake Ishikawa; Masatoshi Kuwabara; Chikara Saito; Tuneyuki Inoue; Masaki Fujita, all of Fukuokaken, Japan

[73] Assignees: Nippon Steel Corporation, Otemachi; Japan Metals and Chemicals Co., Ltd., Tokyo, both of Japan

[21] Appl. No.: 673,174

[22] Filed: Nov. 19, 1984

[51] Int. Cl.[4] ..... C22C 33/00

[52] U.S. Cl. ..... 75/130.5; 75/126 A; 75/257; 106/126

[58] Field of Search ..... 75/130.5, 51, 52, 60, 75/21, 62, 126 A, 257; 106/126

[56] References Cited

U.S. PATENT DOCUMENTS

| | | | |
|---|---|---|---|
| 2,986,459 | 5/1961 | Udy | 75/130.5 |
| 3,012,875 | 12/1961 | Senior | 75/130.5 |
| 3,396,014 | 8/1968 | Keyser | 75/130.5 |
| 3,607,247 | 9/1971 | McCoy | 75/130.5 |
| 3,711,278 | 1/1973 | Josefsson | 75/130.5 |
| 3,847,601 | 11/1974 | Itoh | 75/130.5 |
| 3,854,932 | 12/1974 | Bishop | 75/60 |
| 3,947,267 | 3/1976 | D'Entremont | 75/130.5 |
| 4,053,307 | 10/1977 | Kitayama | 75/130.5 |

*Primary Examiner*—Peter D. Rosenberg

*Attorney, Agent, or Firm*—Wenderoth, Lind & Ponack

[57] ABSTRACT

A process which enables high-chromium alloy such as ferrochromium heretofore obtained by the use of electricity to be produced less expensively in higher yield of chromium by the smelting reduction using solid carbonaceous material such as coke in the place of electricity.

The process of smelting reduction is so performed in the top and bottom blowing converter divided into two stages: the first stage for carrying out the converter operation under continued supply of the raw materials containing pre-reduced chromium oxide (chromium ore) and the second stage for carrying out the converter operation under suspended supply of the raw materials containing the pre-reduced chromium oxide, and the first stage of converter operation is carried out under conditions such that the temperature of the molten metal remains at or below 1,650° C. and the ratio of the volume of the gas generated per minute by the substances supplied through the tuyere for bottom blowing to the combined weight of the molten metal and the molten slag falls in the range of 100 to 2,500 [Nl/min.t] and the second stage of converter operation is carried out under conditions such that the temperature of the molten metal remains at or below 1,650° C., the ratio of the volume of gas generated per minute by the substances supplied through the tuyere for bottom blowing to the combined weight of the molten metal and the molten slag falls in the range of 100 to 1,800 [Nl/min.t].

8 Claims, 25 Drawing Figures

PROCESS FOR PRODUCTION OF HIGH-CHROMIUM ALLOY BY SMELTING REDUCTION

BACKGROUND OF THE INVENTION

1. Field of the Invention

This invention relates to a process for the production of high-chromium steel by the smelting reduction of chromium oxide, such as chromium ore, by using a solid carbonaceous substance, such as coke, as a combination heat source and reducing agent instead of using electric power as a heat source. The term "high-chromium alloy" as used in this invention means an alloy formed preponderantly of Cr—Fe—C and used as a chromium source for the production of high-chromium steel. Because of the function to be fulfilled as a chromium source, this alloy is required to have a chromium content of not less than 17%.

2. Description of the Prior Art

Heretofore, the high-chromium alloy such as, for example, ferrochromium having a chromium content of at least 50% has been produced by heating, melting, and reducing chromium ore or partially reduced chromium ore as disclosed in Japanese Patent Application Laid-open SHO No. 52(1977)-138418, for example. This process, however, has entailed the following problems.

(1) The cost of production is high because expensive electric power is used as reducing energy.

(2) The slag discharged from the furnace has a high chromium content of 2 to 5%, indicating the process to involve a heavy loss of chromium. Further, since the slag has such a high chromium content, it finds utility in a limited range of applications.

Japanese Patent Application Laid-open SHO No. 50(1975)-108116 discloses a process for the production of low-carbon chromium-containing steel and ferrochromium alloy from a high-carbon chromium-containing alloy by supplying oxygen or oxygen-containing gas into a molten metal covered with slag through at least one nozzle located beneath the level of the molten metal, which process is characterized in that, in order to decrease slaglization of chromium, a finely divided solid carbon carrier is supplied into the molten metal through one or more additional nozzles which belongs to the aforementioned oxygen nozzle, in such a manner that the carbon carrier encases the stream of oxygen.

The prior art, however, has not yet produced any effective means of causing the smelting reduction of chromium oxide such as chromium ore without use of electric power.

SUMMARY OF THE INVENTION

If the so-called smelting reduction process which switches the reducing energy from electric power to a less expensive primary energy (heat of the combustion of such carbonaceous solid as coal or coke) is developed and the conditions which permit the chromium content of the slag produced in the process to be sufficiently lowered are found, then this process ought to bring about immense advantages. For the development of this process, however, the following problems must be solved.

(1) The smelting reduction process must rely upon the heat of the oxidation of a carbonaceous material for supply of the energy for heating and melting raw materials and reducing oxides. For the amount of heat generated per the amount of the carbonaceous material to be improved, not only the reaction of $C \rightarrow CO$ but also the reaction of $C \rightarrow CO \rightarrow CO_2$ is desired to be utilized to the fullest extent. In other words, for efficient generation of heat, the atmosphere must be reduced oxidative. What measure, then, has to be taken to satisfy simultaneously this requirement and the requirement that the reduction should be made to proceed to the extent of amply lowering the chromium content in the slag?

(2) Since the chromium component in the chromium ore forms spinel which is sparingly fusible, the melting of the chromium ore and the reduction of the chromium component proceed at low rates of speed. Further, since the chromium ore contains such oxides as MgO, $Al_2O_3$, and $SiO_2$ in large amounts, the amount of the slag produced in the process is very large. What measure, then, has to be taken to promote the reaction which is thus expected to proceed at a low rate of speed?

(3) The conventional low shaft electric furnace is advantageous in respect that the hot temperature part due to the heat of the arc and the furnace wall are isolated from each other by the melt filling the furnace and that the lining forming the furnace wall is consumed only sparingly because the melt generates virtually no flow near the furnace wall. In contrast to the smelting fusion process, since the degree of heat concentration is low, the load upon the lining is increased when the melt is stirred hard or the overall temperature of the reaction part is elevated for the promotion of the reaction. What measure, then, has to be taken to curb injury to the lining?

Since these problems remain yet to be solved, no process other than the electric furnace process has ever been feasibilized for the refinement of ferrochromium. None of the research results reported to date offers a thorough solution to all the problems described above.

An object of this invention is to solve the aforementioned problems and establish a commercially feasible process for the smelting reduction of chromium oxide such as chromium ore without requiring use of any electric power.

Specifically, this invention aims to enable the production of ferrochromium which has been heretofore accomplished by the method utilizing expensive electric power as the source of energy to be carried out in a higher yield of chromium than the conventional electric furnace process by the smelting reduction process utilizing less expensive carbonaceous substance and oxygen as sources of heat. Thus, the present invention provides a process for the production of high-chromium alloy, which enables ferrochromium to be obtained less expensively than the conventional process.

The aforementioned technical problems which stand in the way of the development of the smelting reduction process are solved by this invention providing a process for effecting smelting reduction of chromium oxide such as chromium ore by supplying a top and bottom blowing converter with partially reduced chromium ore, a carbonaceous material, flux, and oxygen or a gas containing oxygen, and causing smelting reduction of the partially reduced chromium ore in the converter, wherein the smelting reduction stage is divided into two phases, i.e. the first phase for carrying out the converter operation under continued supply of the raw materials containing pre-reduced chromium oxide (chromium ore) and the second phase for carrying out the converter operation under suspended supply of the raw materials containing the pre-reduced chromium oxide, and the first phase of converter operation is carried out under conditions such that the temperature of the molten metal remains at or below 1,650° C. and the ratio of the volume of the gas generated per minute by the substances supplied through the tuyere for bottom blowing to the combined weight of the molten metal and the molten slag falls in the range of 100 to 2,500 [Nl/min.t] and the second phase of converter operation is carried out under conditions such that the temperature of the molten metal remains at or below 1,650° C., the ratio of the volume of gas generated per minute by the substances supplied through the tuyere for bottom blowing to the combined weight of the molten metal and the molten slag falls in the range of 100 to 1,800 [Nl/min.t], the free carbonaceous material satisfies the relation of the following formula:

$$\frac{C_F}{\text{Amount of slag}} \geqq 20 \text{ kg/t}$$

wherein $C_F = W_c - 0.54\,[(\bar{a}+\bar{b})/100]V$, $W_c$ standing for the accumulative value (kg) of the carbon content of the carbonaceous material supplied, $\bar{a}$ and $\bar{b}$ each for the integral averages of CO% and $CO_2$% in the waste gas composition, and V for the flow volume of the waste gas ($Nm^3$), and the slag composition satisfies the relation of the following formula:

$$\frac{(\text{CaO }\%) + 1.39\,(\text{MgO }\%)}{(\text{SiO}_2\,\%) + 1.18\,(\text{Al}_2\text{O}_3\,\%)} = 0.7 \text{ to } 1.5$$

$$(\%\ \text{Al}_2\text{O}_3) \leqq 25\%$$

The other objects and characteristic features of the present invention will become apparent to those skilled in the art as the dislosure is made in the following description of a preferred embodiment of the invention, as illustrated in the accompanying drawings.

BRIEF DESCRIPTION OF THE DRAWINGS

and the $Al_2O_3$ concentration upon the rate constants $k_0$, $k_1$ as determined by the test using the apparatus of FIG. 1.

upon the loss index of lining by fusion.

(the amount of free carbonaceous material defined to be the value resulting from the deduction of the amount of carbon converted into CO or $CO_2$ gas from the amount of carbon in the carbonaceous material supplied into the smelting reduction furnace) upon the course of decrease of chromium content of the slag during the second phase of smelting reduction stage, wherein:

$$\log \frac{(T.Cr)t = 0.2}{(T.Cr)t_0 - 0.2} = -\,k_1(t - t_0) \qquad (1)$$

$$k_1 = (\text{Const.}) \times \left(\frac{\text{Amount of free carbonaceous material (kg)}}{\text{Amount of slag (kg)}}\right)$$

Figure 15:
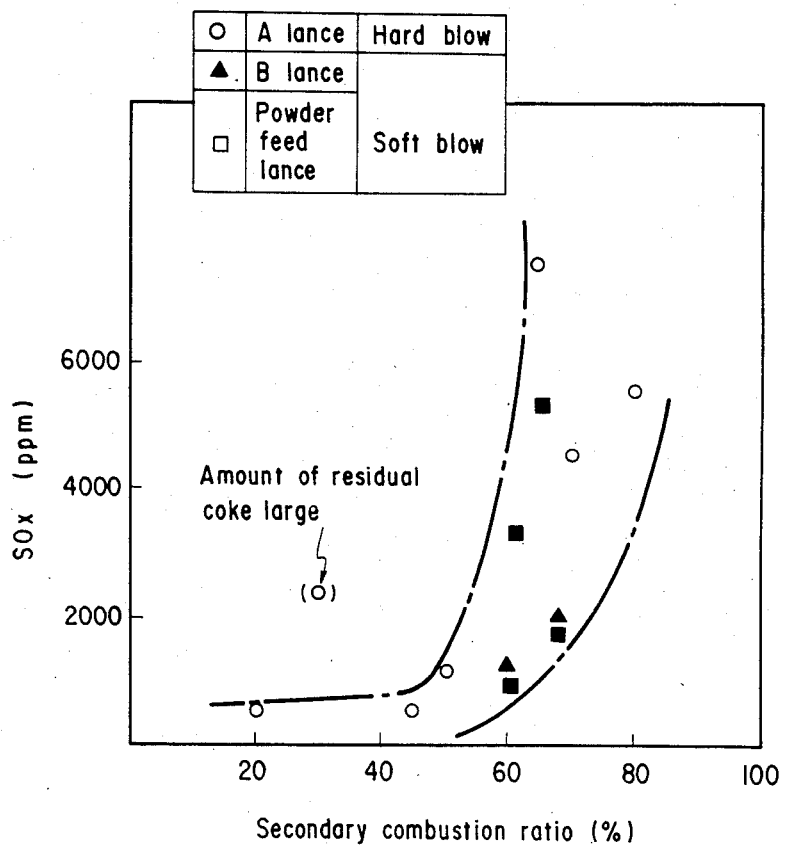
Figure 16:
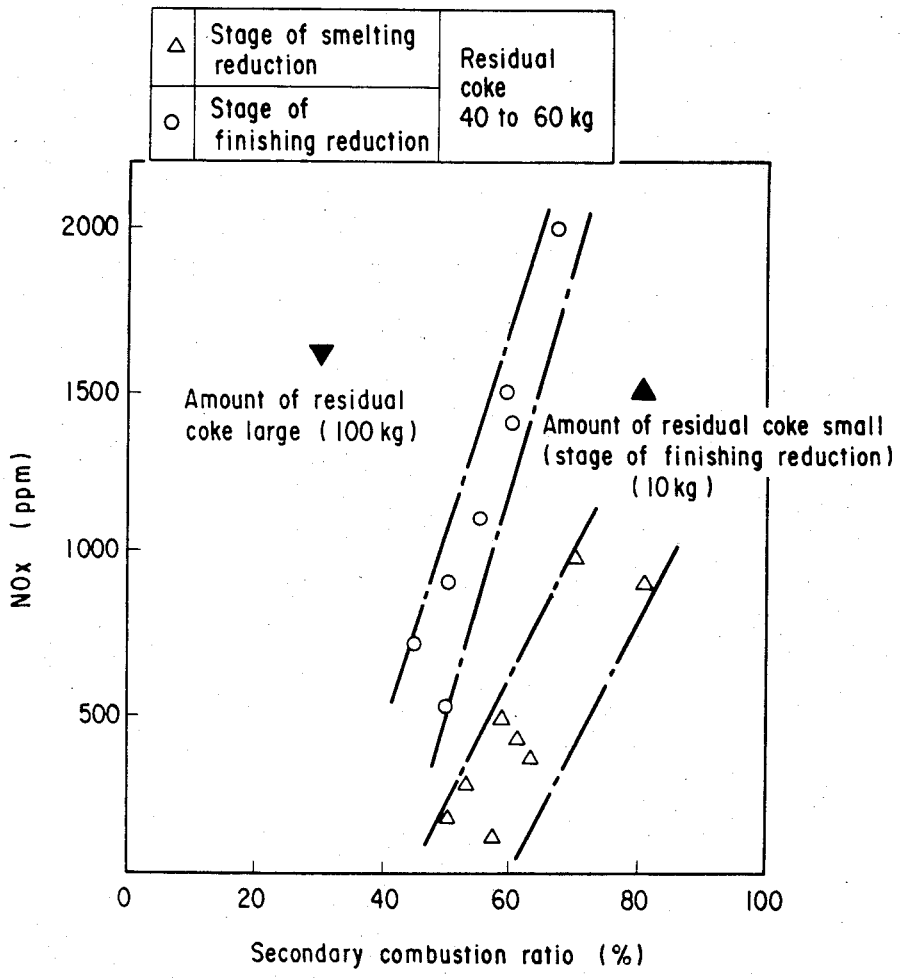

(T.Cr)t=(T.Cr)% after elapse of t minutes of time
$k_1$=rate constant (1/min)

and the formula (1) represents a formula of first order reaction velocity (equilibrium (T.Cr)%=0.2%). FIG. 15 is a diagram illustrating the correlation between the ratio of secondary combustion and the amount of $SO_x$ generated in the process of the present invention. FIG. 16 is a diagram illustrating the correlation between the ratio of secondary combustion and the amount of $NO_x$ generated in the process of the present invention.

Figure 17:
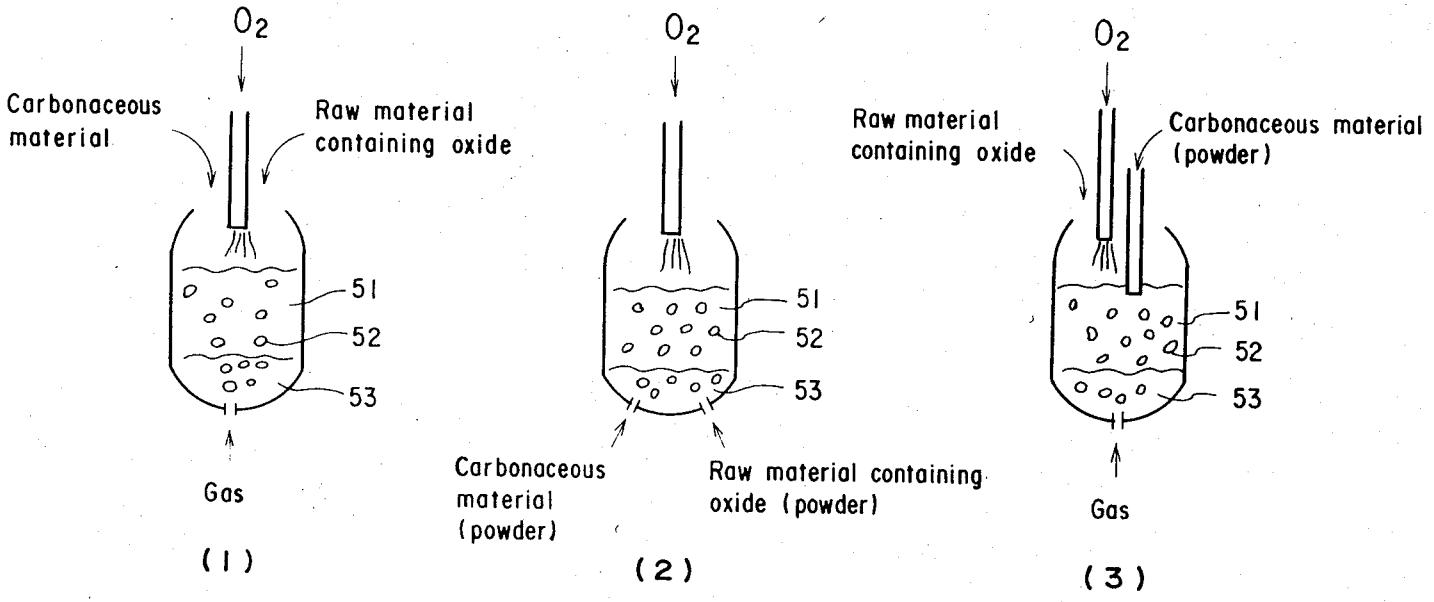
Figure 18:
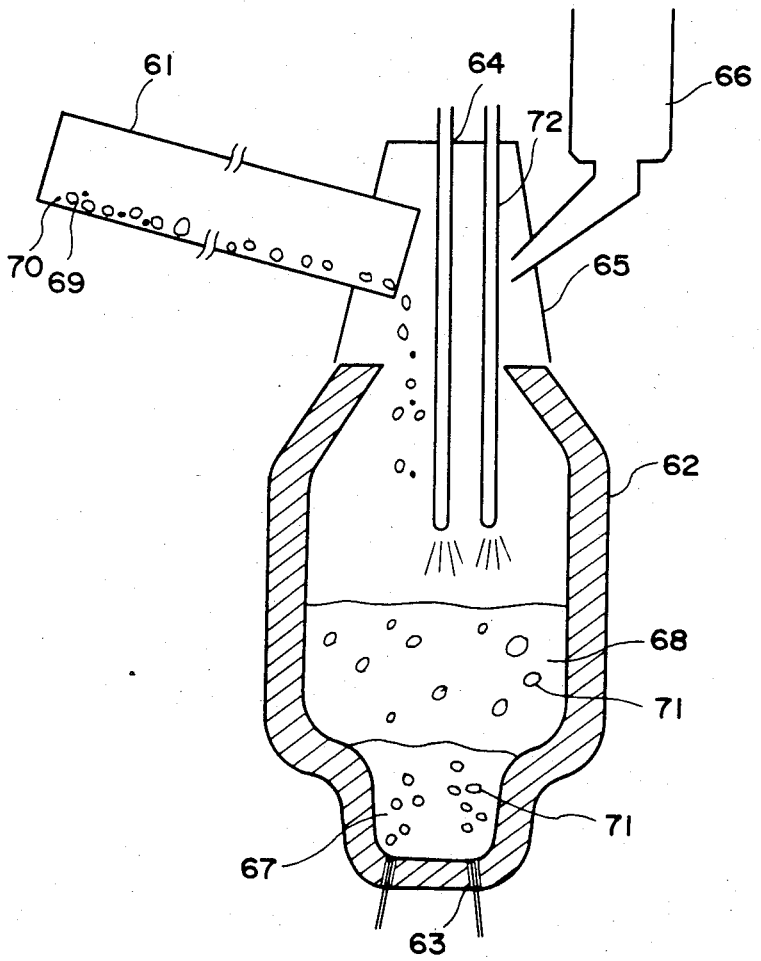
Figure 19:
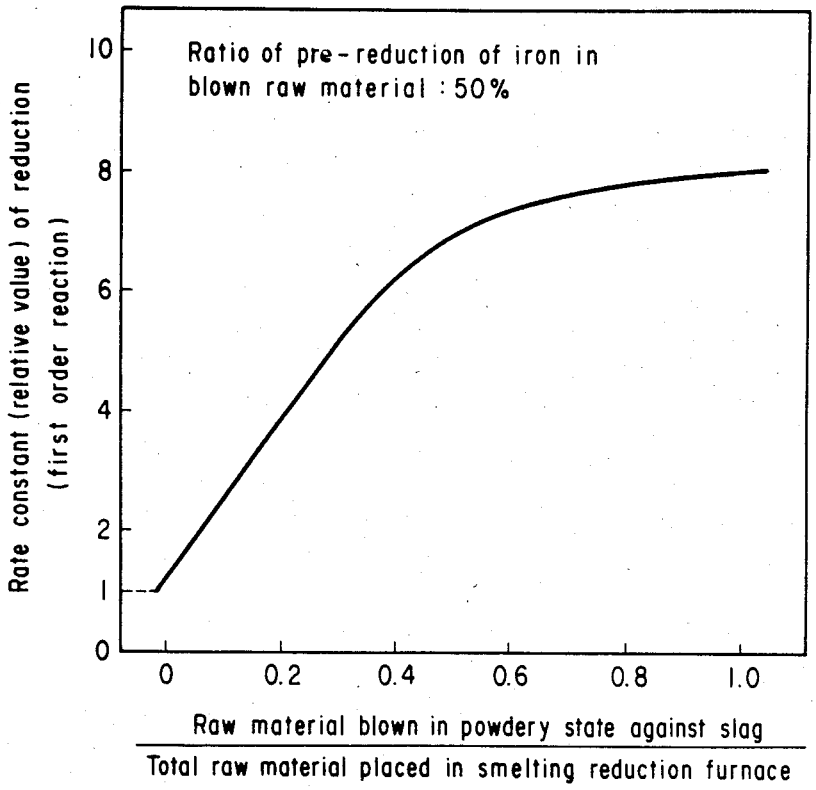
Figure 20:
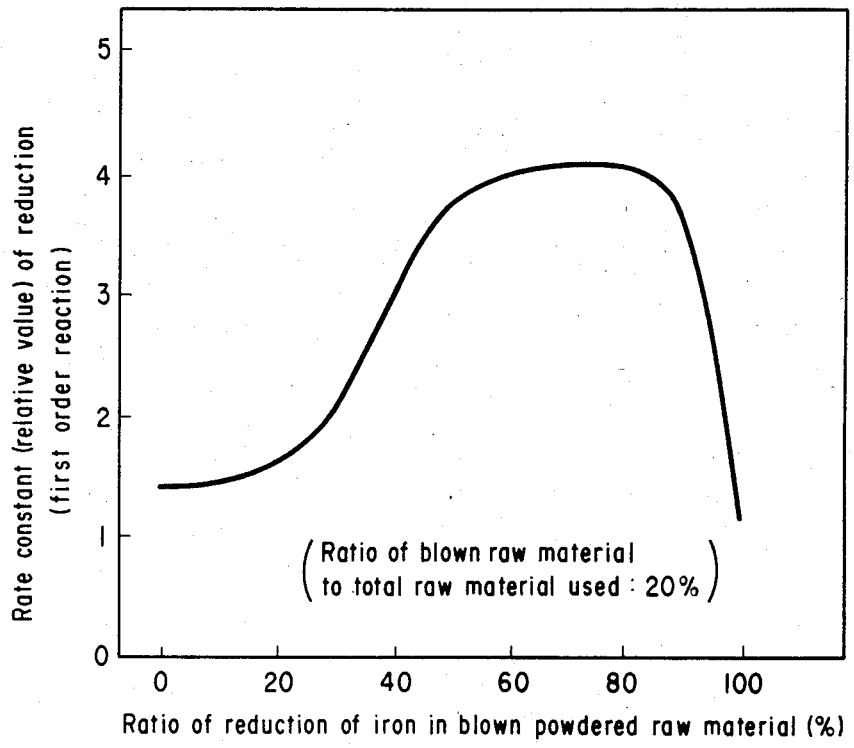
Figure 21:
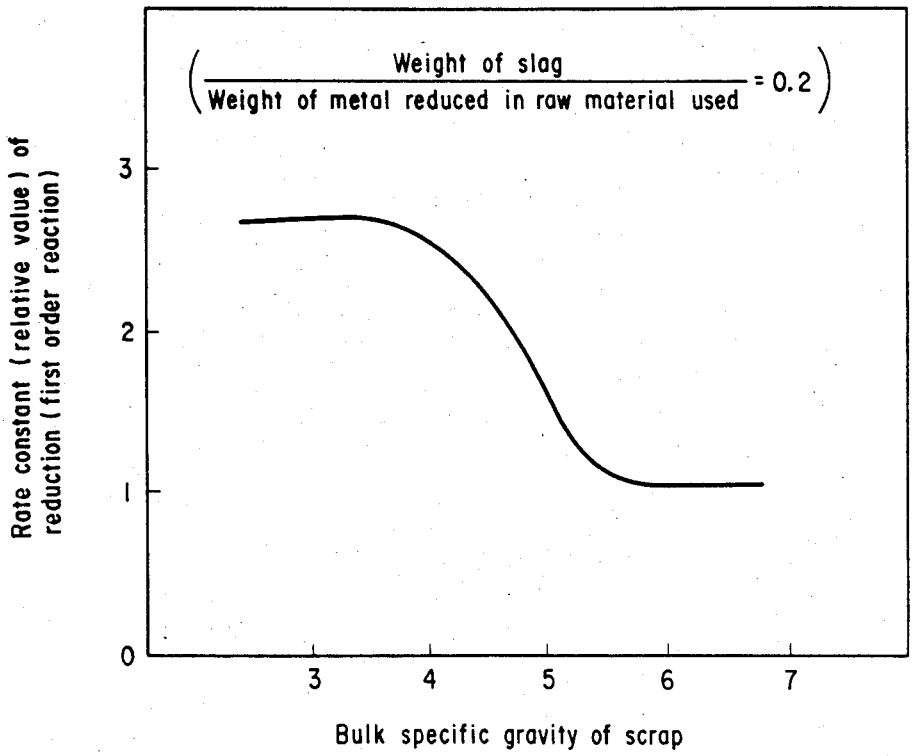

FIG. 17 is an explanatory diagram illustrating three methods for promoting the smelting reduction reaction in a converter. FIG. 18 is an explanatory diagram illustrating a typical smelting reduction furnace to be used for working the present invention. FIG. 19 is a diagram illustrating the relation between the effect in the promotion of the reduction reaction by the blowing of the powdered raw material containing iron oxide (pre-reduction ratio of the iron content in the blown raw material=50%) upon the slag (which effect to be evaluated by the rate constant determined on the first order reaction formula) and the ratio of the portion of raw material affected by the blowing. FIG. 20 is a diagram illustrating the effect of the pre-reduced iron content of the powdered raw material (the ratio of portion of all the raw material affected by blowing=20%) upon the effect in the promotion of the reduction reaction. FIG. 21 is a diagram illustrating the relation between the bulk specific gravity of scrap and the effect in the promotion of reduction reaction as determined in the operation effecting the increase of metal amount in the slag by the addition of scrap $$\left(\frac{\text{weight of scrap}}{\text{amount of metal reduced in supplied raw material}} = 0.2\right).$$

Figure 22:
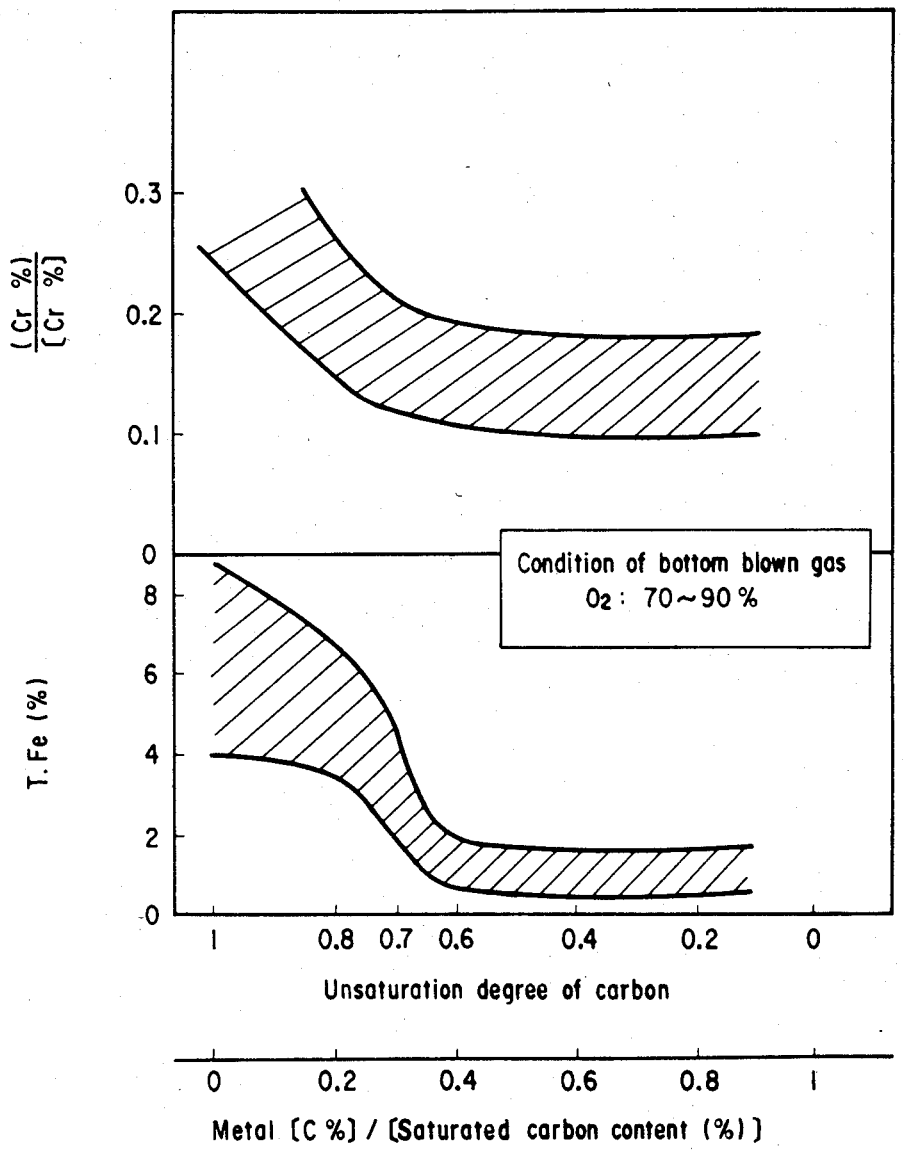
Figure 23:
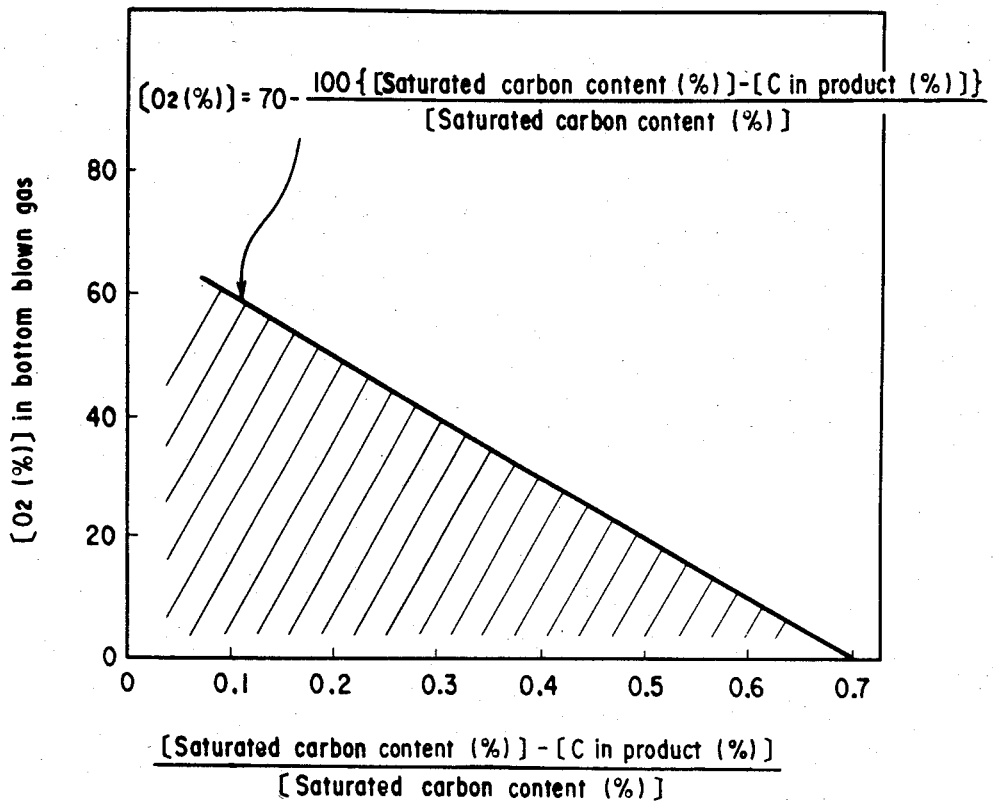
Figure 24:
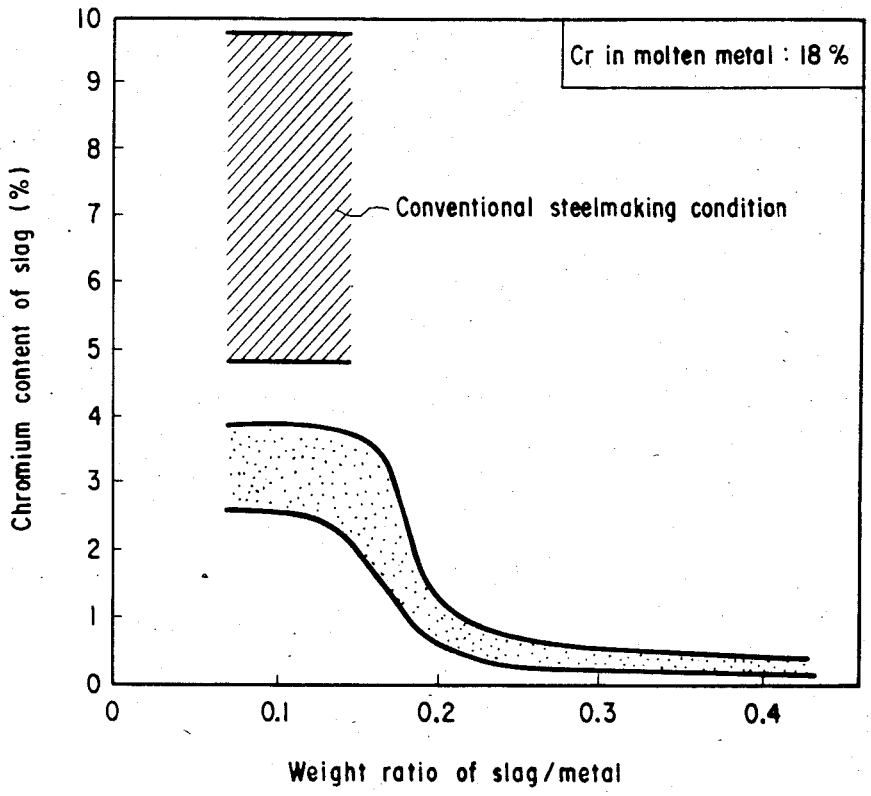
Figure 25:
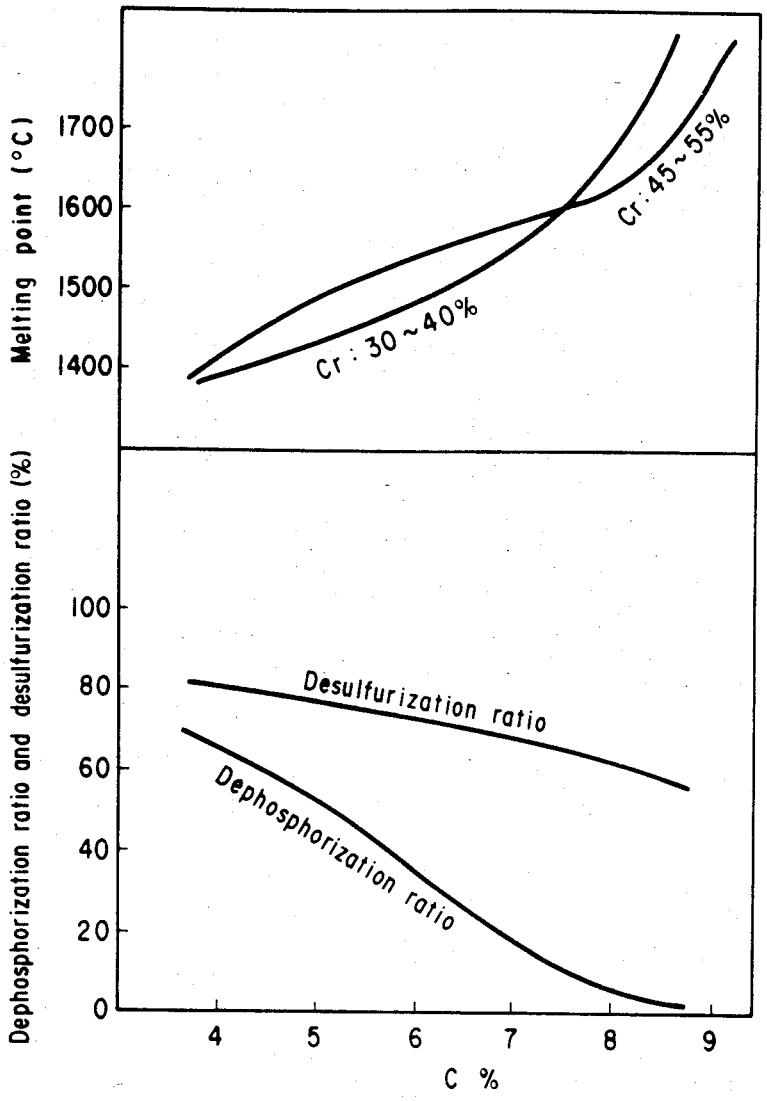

FIG. 22 is a diagram illustrating the relation between the metal [C(%)] and the unsaturation degree of carbon $$\left(\frac{[\text{saturated carbon content (\%)}] - [\text{metal C \%}]}{[\text{saturated carbon content (\%)}]}\right)$$

on one part and (Cr%)/[Cr%], (T.Fe%) on the other part. FIG. 23 is a diagram illustrating the range of oxygen content [$O_2$(%)] in the bottom blown gas (hatched portion) necessary for the repression of the molten metal from reoxidization during the second stage of the smelting reduction by the present invention, as indicated in relation to the unsaturation degree of carbon. FIG. 24 is a diagram illustrating the effect of the slag weight/metal weight ratio upon the yield of chromium by the top and bottom blowing converter. FIG. 25 is a diagram illustrating the relation between the amount of carbon in the high-chromium molten metal (Cr: 30 to 40%) and the efficiency of refining obtained in subjecting the molten metal at the temperature of the molten metal outside the furnace to dephosphorization-desulfurization treatments with a $CaC_2$—$CaF_2$ type flux ($CaC_2$ (80%)—$CaF_2$ (20%), 10 kg flux/t-metal).

DETAILED DESCRIPTION OF PREFERRED EMBODIMENTS

This invention relates to a process for the production of high-chromium steel by the smelting reduction of chromium oxide such as chromium ore without requiring use of an electric furnace.

For the purpose of attaining the object of this invention, the inventors carried out the following tests on the reduction of chromium ore to study main factors affecting the reduction.

Figure 1:
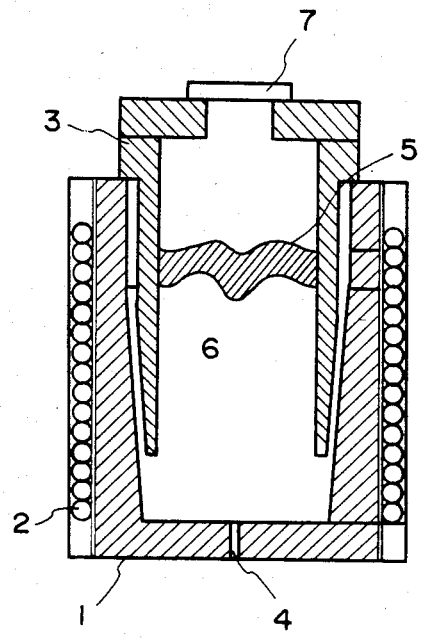
FIG. 1 is an explanatory diagram illustrating a basic test apparatus for reducing about 70 kg of molten metal to study the process of reduction taking place on chromium oxide.
Figure 2:
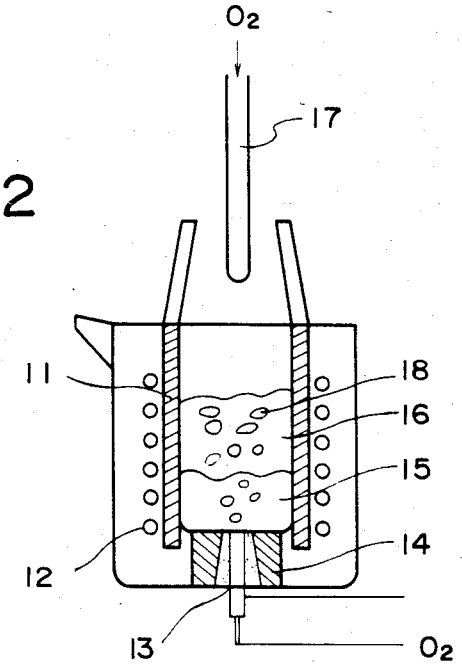
FIG. 2 is an explanatory diagram illustrating a basic test apparatus for reducing about 550 kg of molten metal to study the process of reduction taking place on chromium oxide during oxygen supply.

FIG. 1 depicts a test apparatus making use of a 100-kg high-frequency induction melting furnace. In this test apparatus, about 70 kg of carbon-saturated molten metal is dissolved and a graphite ring 3 is inserted into the molten metal to keep slag 5 from direct contact with a lining 1 and preclude undesired variation in the composition and quantity of the slag. Pellets of chromium ore or partially reduced chromium ore are thrown in the molten metal to study the time-course decrease of the chromium content of the slag. This test apparatus is not adapted to permit feed of oxygen. The temperature of the metal can be adjusted to a desired level by adjusting the induced electric power exerted upon a coil 2. In the diagram, 2 stands for a heating coil, 4 for a porous plug for argon blowing, 6 for a carbon-saturated high-chromium molten metal, and 7 for a lid. FIG. 2 is a test apparatus for studying the time-course variation of the chromium concentration in the slag during the supply of oxygen. In this test apparatus, the behavior of slag component can be followed by placing about 550 kg of molten metal in the converter, keeping the heat of the molten metal with the coil wound on the furnace shell, blowing oxygen into the furnace interior from the top and the bottom, charging chromium pellets, flux, and carbonaceous material in the furnace, and sampling the slag at intervals. In the diagram, 11 stands for dolomite bricks, 12 for a heating coil, 13 for a double-tube tuyere for bottom blowing, 14 for magnesia carbon bricks, 15 for molten metal, 16 for slag, 17 for a top blowing lance, and 18 for a bubble.

Figure 3:
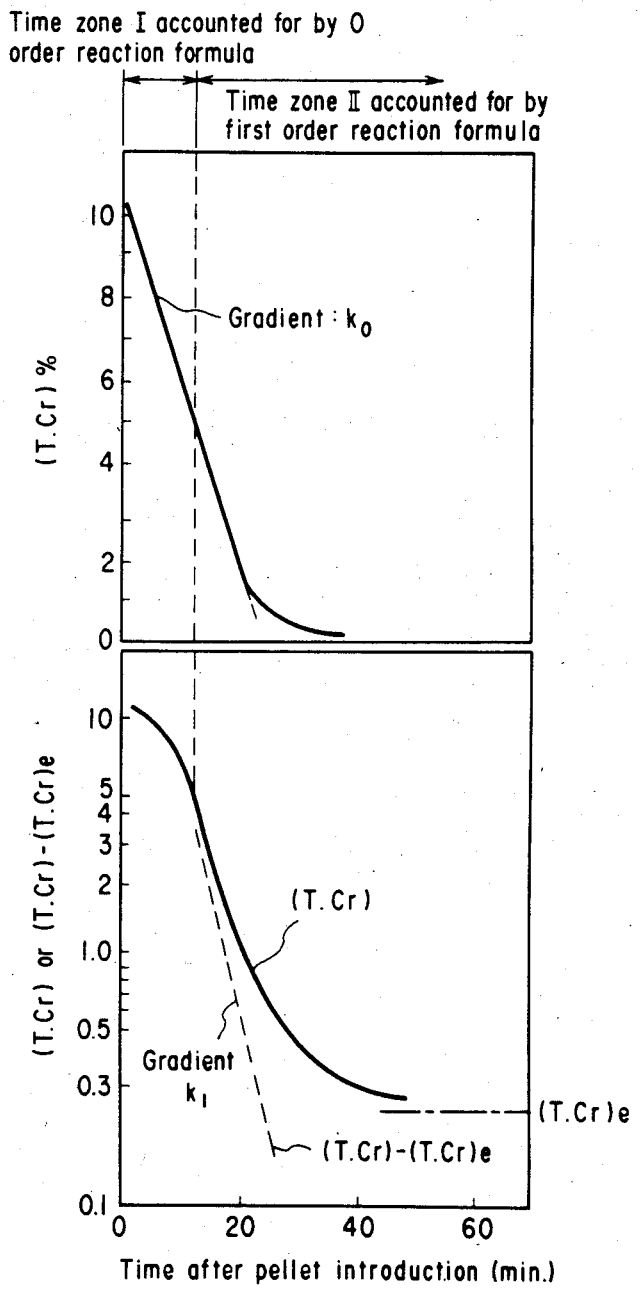
FIG. 3 is a diagram illustrating the condition of typical change of chromium concentration in the slag as determined in the test carried out by using the apparatus of FIG. 1 or FIG. 2.

FIG. 3 represents a typical pattern of the variation in the chromium concentration in the slag after addition of chromium pellets. The behavior of the chromium concentration in the slag can be divided into the region I in which the behavior can be approximated with the zero order reaction and the region II in which the behavior can be accounted for as the first order reaction. The smelting reduction reaction property of chromium can be expressed by the rate constant $k_0$ in the region of zero order reaction, the rate constant $k_1$ in the region of the first order reaction, and the apparent equilibrium chromium concentration $(T.Cr)_e$ of the slag.

Table 1 shows collectively the effects of main factors upon the values of these properties $k_0$, $k_1$, and $(T.Cr)_e$. The amount of the carbonaceous material has a large effect upon the magnitude of $k_1$ (FIG. 4) and the presence or absence of free carbonaceous material has a large effect upon the final value of (T.Cr) (FIG. 5).

TABLE 1

| | Effects of main factors upon smelting reduction property of chromium oxide (a blank column indicating minimal effect) | | |
|---|---|---|---|
| | $k_0$ | $k_1$ | $(T \cdot Cr)_e$ |
| Amount of carbonaceous material | — | Increases in proportion as amount of free carbonaceous material increases (FIG. 4). | Affected by presence or absence of free carbonaceous material (FIG. 5). |
| Condition of oxygen blowing | — | — | Not affected where slag and free carbonaceous material coexist in prescribed amounts (FIG. 5). |
| Temperature | Increases in proportion as temperature rises (FIG. 6). | Increases in proportion as temperature rises (FIG. 6). | — |
| Slag composition | Affected heavily by $\frac{(CaO\ \%) + 1.39(MgO\ \%)}{(SiO_2\ \%) + 1.18(Al_2O_3\ \%)}$ and $(Al_2O_3\ \%)$ (FIG. 7). | Affected heavily by $\frac{(CaO\ \%) + 1.39(MgO\ \%)}{(SiO_2\ \%) + 1.18(Al_2O_3\ \%)}$ and $(Al_2O_3\ \%)$ (FIG. 8). | — |

TABLE 1-continued

| | Effects of main factors upon smelting reduction property of chromium oxide (a blank column indicating minimal effect) | | |
|---|---|---|---|
| | $k_0$ | $k_1$ | $(T \cdot Cr)_e$ |
| Strength of stirring | Increases in proportion as strength of stirring increases. | Increases in proportion as strength of stirring increases. | — |
| Kind of pellets | Affected by presence or absence of coal in raw material and presence or absence of pre-reduction (FIG. 9). | — | — |

Figure 6:
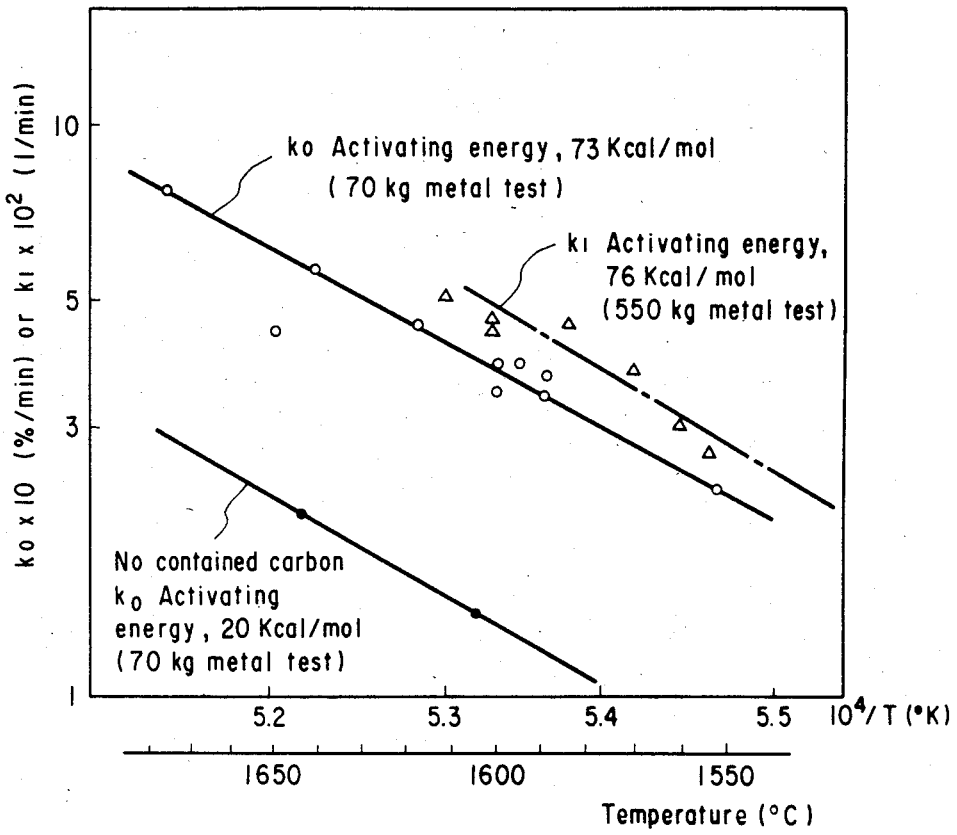
FIG. 6 is a diagram illustrating the relation between the rate constants $k_0$, $k_1$ and the temperature as determined by the test using the apparatuses of FIG. 1 and FIG. 2.
Figure 7:
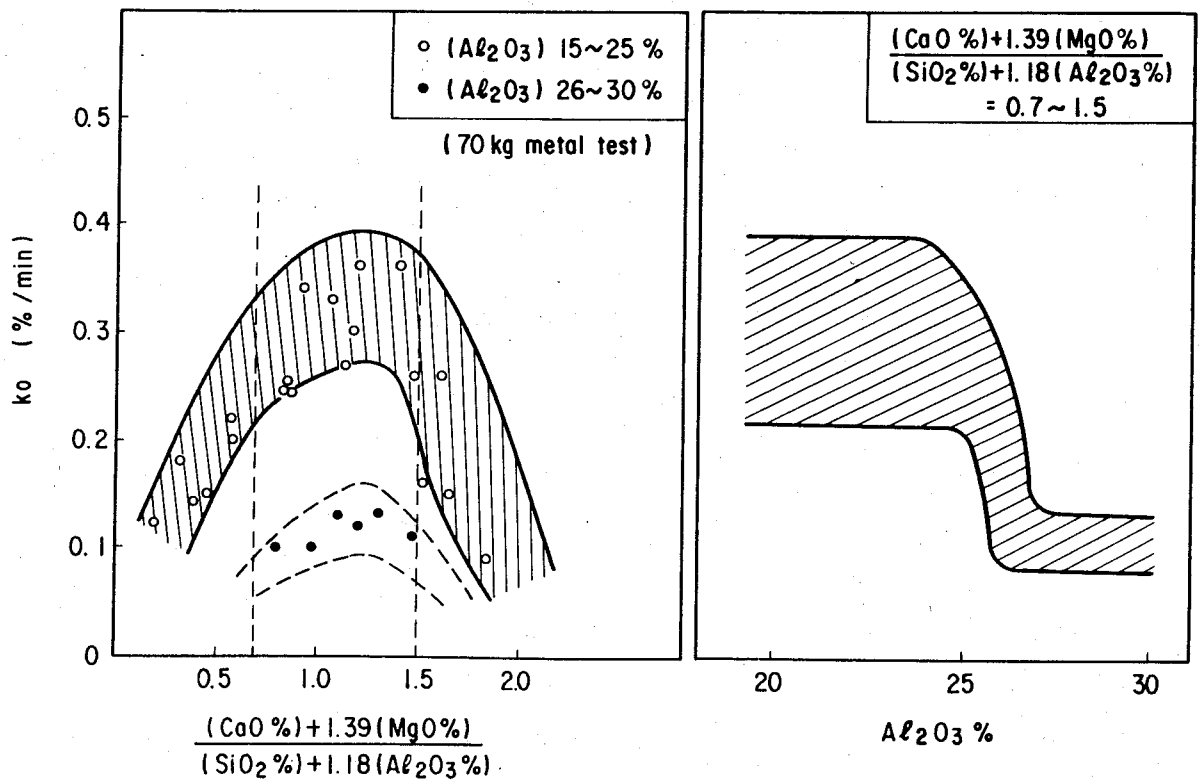
FIG. 7 and FIG. 8 are diagrams illustrating the effects of the slag composition, $$\frac{(\text{CaO }\%) + 1.39\,(\text{MgO }\%)}{(\text{SiO}_2\,\%) + 1.18\,(\text{Al}_2\text{O}_3\,\%)},$$
Figure 8:
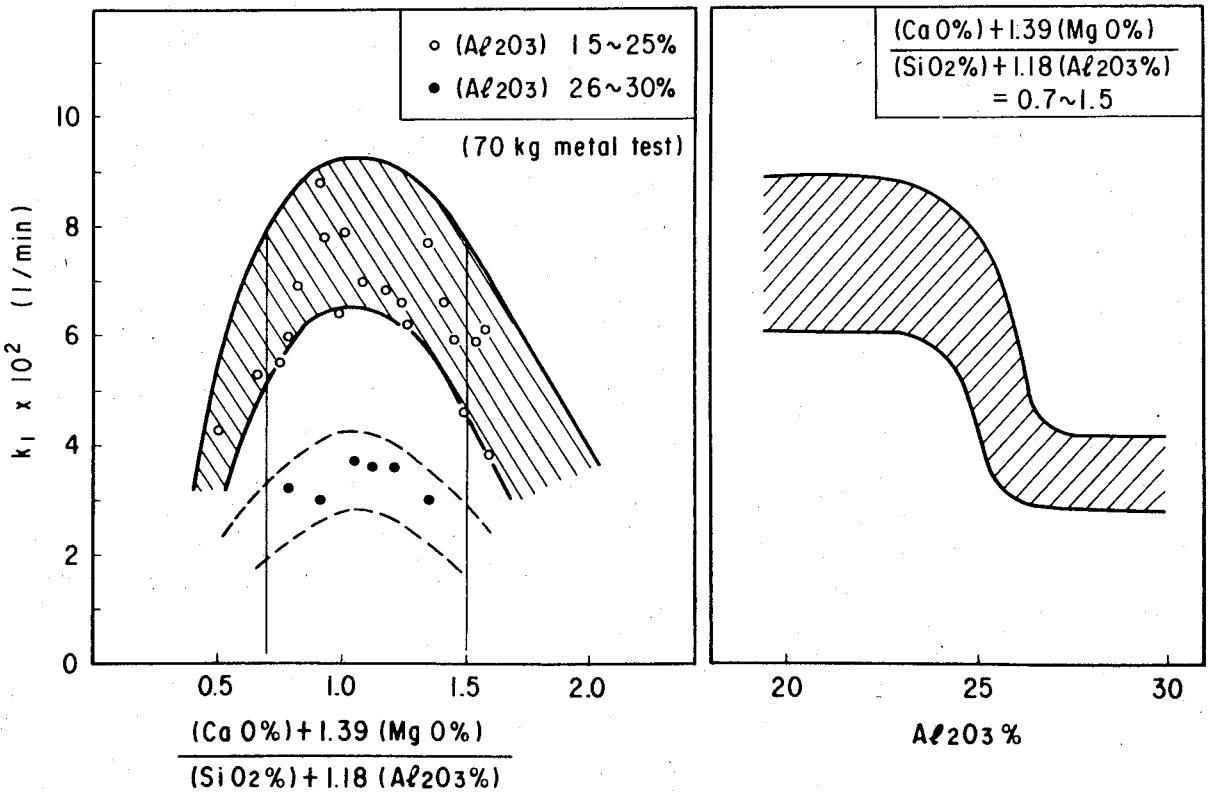
Figure 9:
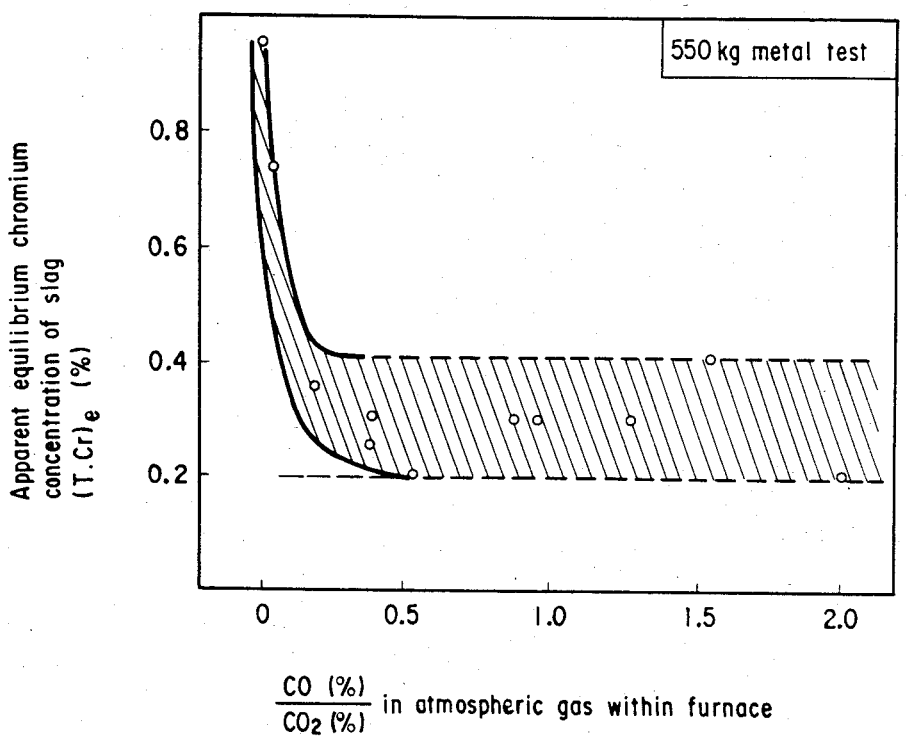
FIG. 9 is a diagram illustrating the relation between the atmospheric composition ($CO/CO_2$) in the furnace and the apparent equilibrium chromium concentration of the slag as determined by the test using the apparatus of FIG. 2.
Figure 10:
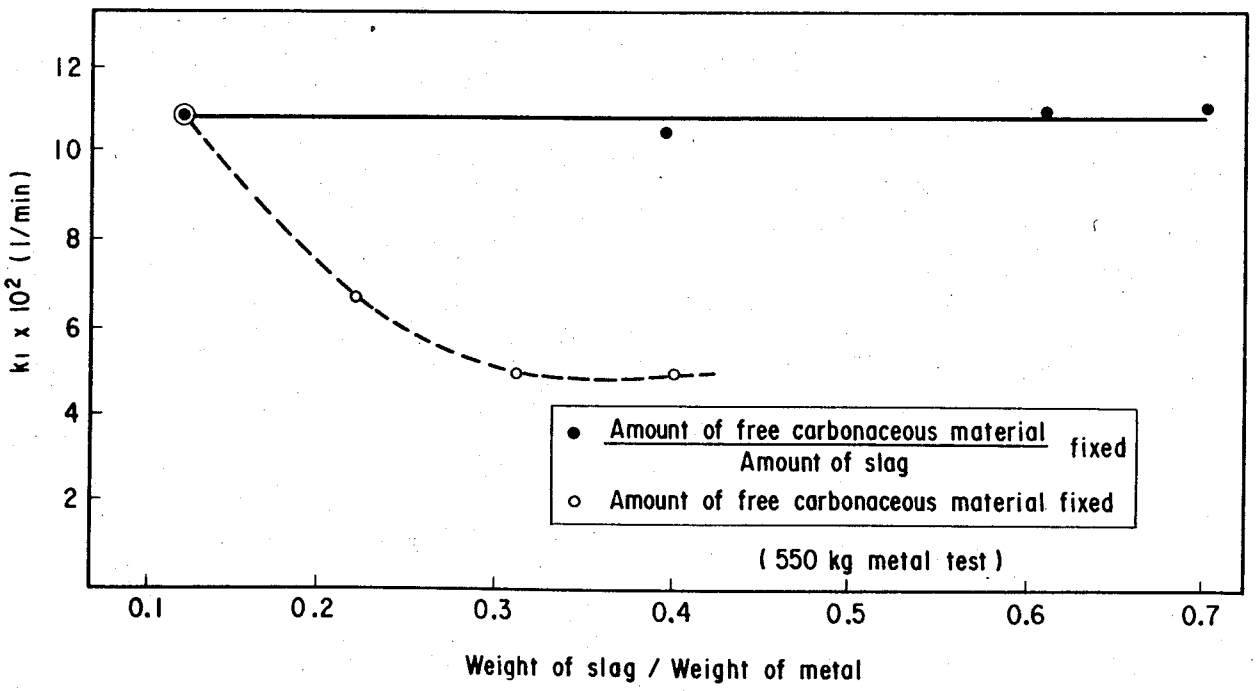
FIG. 10 is a diagram illustrating the effects of slag weight/metal weight ratio and free carbonaceous material weight upon the rate constants $k_0$, $k_1$ as determined by the test using the apparatus of FIG. 2.

So long as the amount of the slag exceeds a certain level and the free carbonaceous material is present, the presence or absence of oxygen blowing has virtually no effect upon $(T.Cr)_3$. The rate constants $k_0$, $k_1$ both increase with the heightening temperature (FIG. 6) and the elevation of temperature has no appreciable effect upon the chromium concentration $(T.Cr)_e$. The slag composition has a conspicuous effect upon the rate constants $k_0$, $k_1$ (FIG. 7 and FIG. 8). In the range in which the rate constants $k_0$, $k_1$ have large values $$\left(\frac{(CaO\ \%) + 1.39(MgO\ \%)}{(SiO_2\ \%) + 1.18(Al_2O_3\ \%)} = 0.7 \text{ to } 1.5 \text{ and } Al_2O_3 \leqq 25\%\right),$$

the slag composition has no appreciable effect upon the chromium concentration $(T.Cr)_e$. The values of the rate constant $k_0$, $k_1$ can be increased by increasing the strength of stirring. The question as to whether or not the coal for inner charge is added to the pellets largely affects the question as to whether or not the chromium ore is preheated outside the furnace for pre-reduction (FIG. 6). In all the results of the basic study, particularly noteworthy is the fact that the oxidation degree ($CO_2/CO$ ratio) of the atmosphere overlying the slag does not affect the progress of the reduction reaction unless through the agency of temperature under the condition of coexistence of the free carbonaceous material and the slag is respectively prescribed amounts (FIG. 9). Under appropriate operational conditions, therefore, the generation of heat by the oxidation of the carbonaceous material and the promotion of the reduction of chromium to a low level can be simultaneously accomplished. Although in the presence of a given free carbonaceous material, the rate constant $k_1$ decreases with the increasing amount of the slag as shown in FIG. 10, it has been demonstrated that by selecting a free carbonaceous material proper for the amount of the slag, the rate constant $k_1$ can be maintained at a high value even when the amount of the slag is large. The effect of the slag composition upon the rate constants $k_0$, $k_1$ is quite large. It is also noteworthy that the range of the proper slag composition to be obtained is totally different from that which has heretofore been observed in the refinment of ferrochromium by the electric furnace process $$\left(\frac{(CaO\ \%) + 1.39(MgO\ \%)}{(SiO_2\ \%) + 1.18(Al_2O_3\ \%)} = 0.70 \text{ to } 0.85,\quad Al_2O_3 = 22 \text{ to } 30\%\right).$$

This invention has been perfected by drawing data from the basic tests described above, systematically synthesizing these data, and consequently establishing operational conditions befitting a smelting reduction process. The essence of this invention is as follows.

A smelting reduction process for the production of high-chromium alloy by the treatment of chromium ore, a carbonaceous material such as coke, flux such as lime, and an oxidizing gas such as oxygen in a setup combining a pre-reducing furnace such as a rotary kiln and a top and bottom blowing converter, which process is characterized by dividing the entire operation into two stages, i.e. the first stage for conducting the smelting reduction under continued supply of raw materials containing pre-reduced chromium oxide and the second stage for conducting the smelting reduction under suspended supply of raw materials containing chromium oxide, and carrying out the operation in a manner such that, in the first stage, the following two conditions are satisfied:

(i) that the temperature of the molten metal should be kept from exceeding 1,650° C. and (ii) that the parameter S defined by the following formula (1) should fall in the range satisfying the following formula (2):

$$S = \frac{\text{Amount of gas generated by bottom blowing (Nl/min)}}{\text{Weight of molten metal } (t) + \text{Weight of molten slag } (t)} \quad (1)$$

wherein the amount of gas generated by bottom blowing $= 2V_{O2} + (V_{Ar} + V_{N2}) + \frac{1}{2}mV_{Cm}$, $V_{O2}$ standing for the amount of bottom blown $O_2$ (Nl/min), $V_{Ar}$ and $V_{N2}$ for the flow volumes oof bottom blown Ar and $N_2$, and $V_{CnHm}$ for the feed volume of bottom blown hydrocarbon $C_nH_m$ (Nl/min) and $$100\ (\text{Nl/min.t}) \leqq S \leqq 2{,}500\ (\text{Nl/min.t}) \quad (2)$$

and, in the second stage, the following three conditions are satisfied in addition to the condition (i) mentioned above:

(iii) that the following relations should exist:

$$100\ (\text{Nl/min.t}) \leqq S \leqq 1{,}800\ (\text{Nl/min.t}) \quad (3)$$

(iv) that the amount of free carbonaceous material $C_F$ defined by the aforementioned formula (3) should satisfy the following formula (4):

$$C_F = W_c - 0.54 \cdot \frac{(\bar{a} + \bar{b})}{100} \cdot V \quad (4)$$

wherein $W_c$ stands for the accumulative value (kg) of the carbon content in the carbonaceous material supplied, $\bar{a}$ and $\bar{b}$ for the integral averages of CO% and $CO_2$% in the waste gas composition, and V for the flow volume of waste gas ($Nm^3$) and the following formula (5):

$$\frac{C_F}{\text{Amount of slag}} \geqq 20 \text{ kg/t} \quad (5)$$

(v) and that the slag composition should meet:

$$\frac{(\%\ CaO) + 1.39\ (\%\ MgO)}{(\%\ SiO_2) + 1.18\ (\%\ Al_2O_3)} = 0.7 \text{ to } 1.5 \quad (6)$$

$$(\%\ Al_2O_3) \leqq 25\%$$

For the promotion of the reduction of chromium oxide, the temperature is preferred to be as high as permissible from the standpoint of both rate and equilibrium of the reaction. From the standpoint of the lining, however, when the temperature exceeds 1,650° C., the susceptibility of the lining to erosion suddenly grows. This invention, therefore, precludes the lining from erosion by keeping the temperature of the slag and the metal from exceeding 1,650° C. and, for the purpose of keeping the rate constants $k_0$, $k_1$ under that temperature condition above the respective prescribed levels required for the sake of the process, utilizes the high stirring power of the top and bottom blowing converter and pays due attention to the adjustment of other conditions as well.

To be specific, this invention is aimed at establishing a new ferrochromium refining process combining "converter, top and bottom oxygen supply, hard stirring, and operation at relatively low temperature" in the place of the conventional electric furnace process combining "shaft furnace, limited high temperature, and absence of hard stirring."

The top and bottom blowing is fit for the process of this invention for the following reasons.

(1) In the absence of the bottom blowing, the reduction of chromium in the slag proceeds at a low rate because of insufficient stirring. Further, since the molten metal cannot be directly heated, the temperature of the slag is relatively high. Owing to this relatively high temperature of the slag coupled with consequent elongation of the duration of treatment, the lining is subject to a heavy load.

(2) In the exclusive presence of the bottom blowing, the number of tuyeres for introduction of a large volume of oxygen is increased so much as to render the management of facilities difficult. Further, since the combustion of the carbonaceous material has to relay solely upon the oxidation of the metal, the passage of carbonaceous material into the molten metal is retarded and the molten metal tends to undergo re-oxidation as the amount of the slag increases.

Thus, the furnace adapted for the top and bottom blowing proves to be one of the most advantageous forms of furnace for the smelting reduction of ferrochromium.

Figure 11:
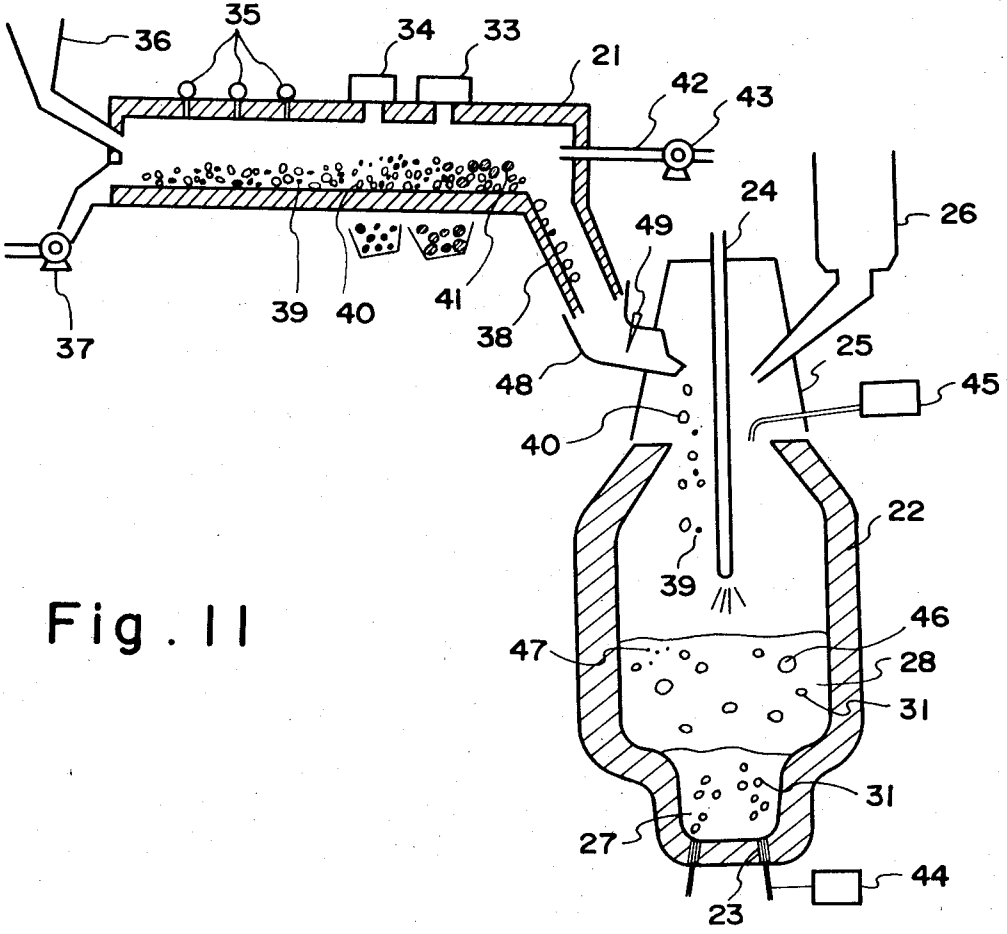
FIG. 11 is an explanatory diagram illustrating a typical setup to be used for working the present invention.

Now, the present invention will be described more specifically below with reference to working examples. One typical setup to be used in working the present invention is illustrated in FIG. 11. In the diagram, 21 stands for a rotary kiln, 22 for a smelting reduction furnace, 23 for a tuyere, 24 for a top blowing lance, 25 for a hood, 26 for a carbonaceous material and flux hopper, 27 for molten metal, 28 for slag, 29 for chromium pellets, 30 for carbonaceous material, 31 for air bubbles, 32 for a pellet storage, 33 for a lime scoop feeder, 34 for a coke scoop feeder, 35 for an air port, 36 for a raw material chute, 37 for an air discharge device, 38 for a pellet outlet concurrently serving as a path for the gas generated in the smelting reduction furnace, 39 for coke, 40 for pellets, 41 for limestone, 42 for an air nozzle, 43 for an air blower, 44 for a device for measuring inner pressure of the tuyere tube, 45 for a waste gas analyzer, 46 for scrap, 47 for metal drops, 48 for a pellet inlet chute, and 49 for a damper. This setup combines the rotary kiln 21 and the top and bottom blowing smelting reduction converter 22. The rotary kiln 21 is operated by using preponderantly the waste gas emanating from the smelting reduction furnace 22 as the fuel and utilized for the purpose of heating the raw materials being fed into the smelting reduction furnace 22, finely pulverizing the chromium ore and the carbonaceous material such as coke, subsequently heating coal-containing chromium pellets to effect partial pre-reduction of iron oxide and chromium oxide, thereby producing preheated and partially reduced pellets, preheating the carbonaceous material such as coke to be used as fuel or reducing agent in the smelting reduction furnace, and preheating lime or roasting limestone to be used as flux. Since the rotary kiln 21 can utilize the sensible heat of the hot gas emanating from the smelting reduction furnace 22, permit heating at a higher temperature than the pre-reducing furnace of any other type, and promote the reduction of chromium oxide, a sparingly reducible substance, to the extent of 50 to 70%, it constitutes a convenient preheating pre-reducing furnace capable of utilizing the waste gas. Since the use of the rotary kiln 21 permits the raw materials to be preheated and pre-reduced, the kiln serves to decrease the amount of the heat required by the smelting reduction furnace per unit amount of the product. Assume, for example, that 70% of the chromium content and 90% of the iron content in the chromium ore are pre-reduced and the chromium ore is supplied as preheated to 1,000° C. in conjunction with the coke to the smelting reduction furnace, and the amount of heat to be generated within the smelting reduction furnace (which heat is generated by the combustion of the carbonaceous material with oxygen) will have to be only about 30% of the amount of heat required where the raw materials are supplied in a state not preheated or pre-reduced in advance. Further, the fact that the greater part of the iron content of chromium pellets is in a pre-reduced state when the pellets are supplied into the smelting reduction furnace brings about an effect in lowering of the total iron content of the slag formed by the fusion of pellets within the smelting reduction furnace and discouraging erosion of the lining. Moreover, as shown in FIG. 6, the pellets charged in the smelting reduction furnace are allowed to increase the rate constant in the region of the zero order reaction and behave advantageously in promoting the reduction reaction.

The smelting reduction furnace 22 is intended to admit the pre-reduced chromium pellets, the carbonaceous material such as coke, and the flux formed preponderantly of lime, melt these raw materials, promote reduction of the surviving oxides of chromium and iron, and obtain finally the slag formed preponderantly of molten chromium-iron type alloy and $MgO$-$SiO_2$-$CaO$-$Al_2O_3$. The converter has been selected among other various types of furnace because it is convenient for realizing the hard stirring of the slag which is indispensable to the promotion of the reaction. This converter is provided with the tuyere 23 (use of a plurality of such tuyeres is permissible) for effecting introduction of an oxygen-containing gas through the bottom of the furnace and the top blowing lance 24 for blowing oxygen downwardly into the furnace interior through the top.

The bottom blowing tuyere 23 functions to adjust the temperature of the metal by blowing the oxygen-containing gas into the metal, realize as the result the stirring of the metal and the consequent hard stirring of the slag, and optionally decarburize the metal for adjustment of the carbon content of the product. Solely for the purpose of the stirring, use of inert gas such as argon or nitrogen may suffice. Even in that case, the cost of the gas used for the stirring and the loss of sensible heat as entrained by the spent gas departing from the furnace constitute important considerations. In due respect of these factors, the use of the oxygen-containing gas proves more advantageous. For the blowing of the oxygen-containing gas into the metal, there can be used a double-tube tuyere so adapted as to blow a small volume of cooling gas such as hydrocarbon, argon, or nitrogen through the outer tube and, thus, prevent the tuyere from loss by fusion.

The supply of oxygen through the top blowing lance constitutes itself principal means of controlling the condition of heat generation within the smelting reduction furnace. The shape of the nozzle of this lance is determined by the amount of oxygen supplied, the size of the furnace, the condition of the waste gas, etc. Further the lance is adapted so that the distance between the leading end of the lance and the slag surface will be adjusted to suit the prevalent operational condition.

Basically, the shape of the smelting reduction furnace is similar to the ordinary converter used for steelmaking. (1) When the ore to be used has a composition such that the amount of the slag to be formed is large, the relative thickness of the layer of the slag is decreased by giving a large diameter to the upper part of the furnace for collecting the slag than to the part of the furnace for collecting the metal. (2) When the load exerted upon the lining in the upper part of the furnace is increased owing to elevation of the secondary combustion ratio within the furnace, that part of the furnace is constructed so as to be cooled with cold water.

Magnesia-carbon type bricks best suit the lining of the smelting reduction furnace in the lower half part thereof (which is virtually always submerged under the slag and the metal). Magnesia-carbon type bricks or chromiummagnesia bricks suit the lining of the same furnace in the upper half part thereof (which is exposed to the atmosphere of $CO-CO_2$ type hot gas). The choice between the two types of bricks hinges on the selection of the value for the $CO/CO_2$ ratio of the waste gas (which value may be freely selected, in the operation of the smelting reduction furnace, within the range of $CO/CO_2 \geqq 0.3$ as illustrated above in FIG. 9).

Optionally, a pellet storage tank may be interposed between the rotary kiln and the smelting reduction furnace as a buffer for matching them.

In a setup wherein the rotary kiln is operated with intervals selected to suit the pattern of supply of raw material as required by the smelting reduction furnace or a combination of two smelting reduction furnaces is installed to match one rotary kiln and the operating cycles of the two smelting reduction furnaces are staggered so as to warrant continuous supply of raw materials, the storage tank may be formed in smaller dimensions or even totally eliminated.

The setup constructed as described above is operated by the following procedure.

The rotary kiln is charged with chromium ore pellets incorporating carbonaceous substance and coke lumps, supplied as heat source chiefly with the hot gas emanating from the smelting reduction furnace, when necessary, in conjunction with heavy oil and some other fuel, and fed with air or an oxygen-enriched air introduced via the air nozzle 42, the air port 35, etc. for control of the combustion, so that the maximum temperature region within the kiln will be kept above the level 1,400° C. required for the reduction of chromium. The carbonaceous material required for the smelting reduction furnace is desired to be wholly supplied through the rotary kiln, except for a small portion thereof which is used for the purpose of adjustment of combustion. This is because the increase in the amount of the carbonaceous material within the kiln serves to preclude the reoxidization of pellets within the high temperature region, enables the reduction ratio of chromium pellets supplied to the smelting reduction furnace to be maintained at a high level, and improves the heat balance of the smelting reduction furnace owing to the preheating of the carbonaceous material itself. When the carbonaceous material so supplied to the kiln is too much to permit ample decrease of the CO content of the gas at the outlet of the kiln, the problem of high CO content of the outlet gas may be solved by feeding part of the carbonaceous material into the kiln at a point falling halfway along the length of the kiln, for example, through the scoop feeder.

As the flux, taking consideration into the composition of the charged chromium ore and carbonaceous material, lime and, if necessary, quartzite or the slag which contains CaO and $SiO_2$ and is formed in the stainless steel production, for example, is added to the smelting reduction converter so as to satisfy the condition of the composition of the slag to be formed. This addition of the flux is effected substantially proportionately to the amount of chromium pellets to be added or, in consideration of the time required for fusion, preferentially to the amount of chromium pellets to be added. The flux can be introduced directly into the smelting reduction furnace through the hopper 26 or it may be fed to the furnace after it has been preheated in the rotary kiln. Particularly, limestone as a source of lime may be roasted within the kiln and the resultant preheated quick lime supplied to the smelting reduction furnace.

In case of a possibility that the chromium pellets react with the flux within the kiln and the reaction product of a low melting point forms a deposit on the kiln wall, this trouble may be precluded by introducing the flux to the neighborhood of the trailing end of the kiln through the scoop feeder 33 or by using a separate preheating device exclusively for the preheating or roasting of the flux.

The rotary kiln is operated substantially in a constant state when the storage tank is large or when the operating cycles of two smelting reduction furnaces are staggered so as to uniformize the amount of pellets supplied along the course of time. Otherwise, the rotary kiln is operated with intervals selected to suit the pattern of supply of raw materials as required for the sake of the operation of the smelting reduction furnace.

The operation of the smelting reduction furnace is started by charging it with the molten iron or molten iron-chromium alloy obtained in some other smelting furnace or by charging it with coke and pig iron or solid ferrochromium, blowing oxygen to melt the metal, and using the resultant molten metal as the starting melt. In the second and subsequent cycles of heating, at least 80% of the slag and about two thirds of the high-chromium molten metal both formed in the preceding cycle of heating are tapped and about one third of the molten metal is left behind within the furnace as the starting melt for the subsequent cycle of heating. The operation of the smelting reduction furnace is continued by repeating this procedure.

First stage of smelting reduction

The aforementioned starting melt is stirred by blowing therein the oxygen-containing gas introduced through the bottom blowing tuyere 23 and the oxygen introduced downwardly from the top through the top blowing lance 24. From the rotary kiln 21, the chromium pellets which have been preheated and prereduced, the carbonaceous material such as coke, and the flux are supplied to the smelting reduction furnace. Consequently, there ensue the generation of heat by the oxidation of the carbonaceous material ($C \rightarrow CO$ or $CO_2$), the reduction of the oxide of chromium or iron by the carbon (dissolved in the solid carbonaceous material or metal), and the formation of slag by MgO, $SiO_2$, and $Al_2O_3$ contained in the chromium pellets, ash in the carbonaceous material, and CaO (occasionally in conjunction with $SiO_2$) added as the flux. The molten slag and the molten metal grow in volume as the addition of raw materials is continued. In the meantime, the rate of supply of the raw materials, the rates of top and bottom oxygen blowing, and the height of the lance nozzle are controlled so as to enable the metal temperature to remain above the starting point of solidification and below 1,650° C. The maintenance of the metal temperature above the starting point of solidification is aimed at prevention of otherwise possible blockade of the bottom blowing tuyere, a requirement indispensable to the accomplishment of this invention. In the presence of the hard stirring which constitutes another indispensable requirement for this invention, the temperature difference between the metal and the slag is so small that the regulation of the metal temperature below the level of 1,650° C. will suffice for protection of the lining against erosion by the slag. The temperature of the metal may be measured with an immersion type thermocouple at intervals of several minutes or it may be estimated with fair accuracy by continuous measurement of the inner pressure of the bottom blowing tuyere. The latter indirect method is based on the phenomenon that when the metal temperature falls, the amount of the deposit (solidified metal and the oxide of chromium) on the tip of the tuyere increases so much as to cause an increase in the inner pressure of the tuyere tube. The relation between the inner pressure of the tuyere and the metal temperature is substantially fixed where the tuyere condition, the condition of the bottom oxygen blowing, and the metal composition are constant. By empirically formularizing this relation in advance, therefore, the metal temperature can be estimated based on the results of measurement of the inner pressure of the tuyere.

The total amount of the oxygen gas to be supplied to the smelting reduction furnace can be determined based on the compositions of the various raw materials to be charged, the temperature condition, the $CO/CO_2$ ratio of the waste gas (which can be freely fixed above the lower limit of 0.3). The average rate of oxygen blowing can be decided by dividing the total amount of oxygen gas required by the time of the first stage of the smelting reduction. The average rate of the top blowing of oxygen is fixed by deducting the amount of oxygen for the bottom blowing which is described afterward. Desired fixation of the $CO/CO_2$ ratio of the waste gas is obtained simply by adjusting the shape of the nozzle of the top blowing lance, the height of the lance nozzle, etc.

Figure 12:
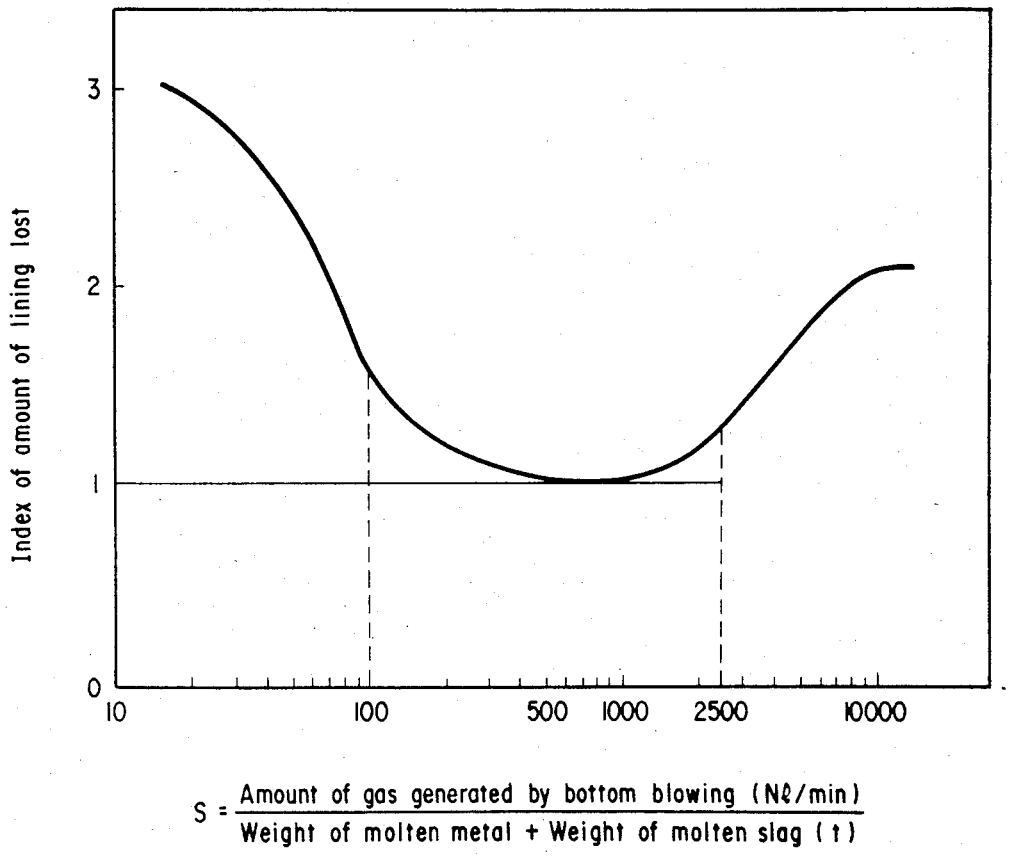
FIG. 12 is a diagram illustrating the effect of the parameter S $$\left(S = \frac{\text{Amount of gas generated by bottom blowing}}{\text{Amount of molten metal + molten slag}}\ (Nl/\text{min}\cdot t)\right)$$

For this invention, the bottom blowing gas is important as constituting the main force for stirring the slag and the metal. This is because the stirring serves the purpose of uniformizing the temperature of the molten metal and that of the slag to the fullest possible extent to increase the rate of reduction of the oxide and minimizing the extent of limited high temperature as the cause for injury to the lining. The stirring of the molten metal and the slag by the bottom gas blowing is effected by the expansion and ascent of the formed gas. Let S (Nl/min.t) defined by the following formula (1) stand for the parameter indicative of the intensity of the stirring, and the relation between the parameter S and the unit ratio index of the lining during the first stage of smelting reduction will be as shown in FIG. 12.

$$S = \frac{\text{Amount of gas generated by bottom blowing (Nl/min)}}{\text{Weight of molten metal } (t) + \text{Weight of molten slag } (t)} \quad (1)$$

wherein the amount of gas generated by bottom blowing $= 2\ V_{02} + (V_{Ar} + V_{N2}) + \frac{1}{2}\ mV_{CnHm}$, $V_{O2}$ standing for the amount of bottom blown $O_2$ (Nl/min), $V_{Ar}$ and $V_{N2}$ for the flow volumes of bottom blown Ar and $N_2$, and $V_{CnHm}$ for the feed volume of bottom blown hydrocarbon $C_nH_m$ (Nl/min). When the intensity of the stirring or the value of the parameter S is excessively small, the unit ratio of the lining is sharply increased because the slag temperature is locally heightened so much as to affect adversely the lining and because the reduction of the oxides of iron and chromium is retarded and the lining is left exposed to the slag containing FeO for a long time. Conversely when the value of S is excessively large, the unit ratio of the lining is similarly increased because the rate of reduction is uniformized without recourse to the force of stirring and because the intensified stirring of the slag contributes to increasing the injury to the lining. Thus, the parameter S is required to fall in the range defined by the following formula.

$$100\ (\text{Nl/min.t}) \leqq S \leqq 2{,}500\ (\text{Nl/min.t}) \quad (2)$$

Second stage of smelting reduction

When the supply of the raw material containing chromium oxide in a prescribed amount (partially reduced chromium pellets) is completed, the operation is shifted to the second stage of smelting reduction which is aimed at the finishing reduction necessary for lowering the chromium content of the slag to a prescribed level. This stage of smelting reduction is expected to fulfil the role of lowering the chromium content of the slag to the prescribed level by suspending the supply of pellets, continuing the top and bottom oxygen blowing while controlling the temperature, also controlling the amount of the free carbonaceous material as the reducing agent, and causing the reduction of chromium to proceed as quickly as permissible without exerting any excessive load upon the lining.

First the metal temperature must be controlled to exceed the starting point of solidification and not to exceed 1,650° C. by the same procedure for the same reason as in the first stage of smelting reduction. The metal temperature is controlled by the conditions of the top oxygen blowing (such as the rate of oxygen blowing and the height of the lance).

Figure 13:
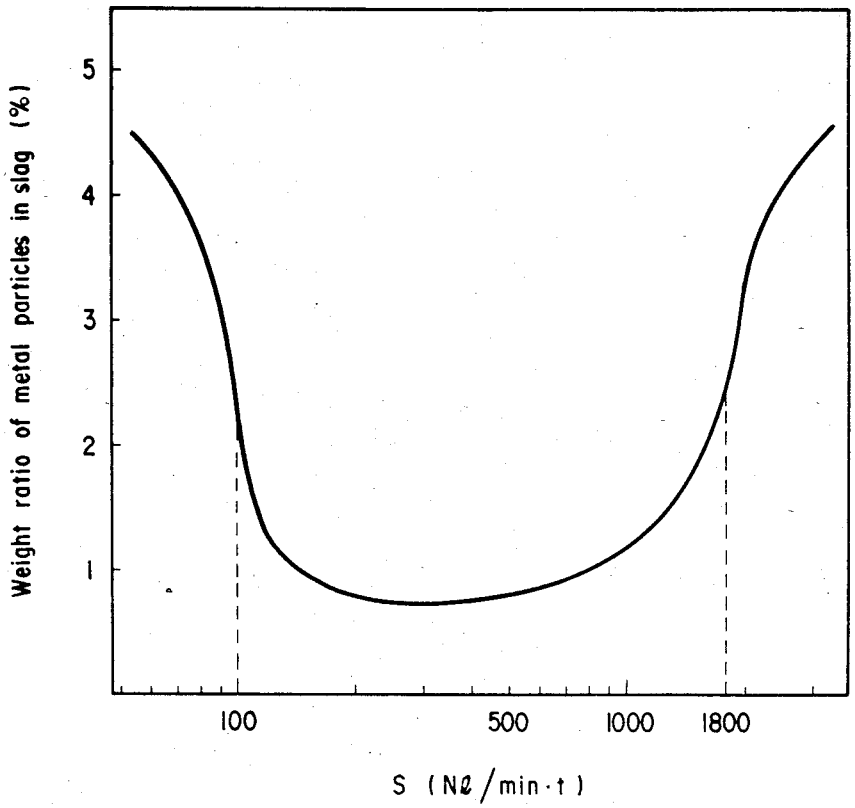
FIG. 13 is a diagram illustrating the effect of the parameter S upon the amount of metal particles present in the slag.

The hard stirring of the slag by the bottom blown gas as important for the second stage as for the first stage of smelting reduction. A relation substantially equal to the relation shown in FIG. 12 applies to the second stage of smelting reduction. Further, the amount of metal particles in the slag at the end of the second stage bears upon the amount of the gas introduced by blowing as indicated in FIG. 13. This is because the fine metal particles (several microns in diameter) issuing from fine chromium spinel have no fair chance of being conglomerated and precipitated when the stirring is excessively weak, whereas the molten metal is blown up and passed into the slag to increase the amount of metal particles when the stirring is excessively strong. Thus formed metal particles in the slag can not be completely separated during the killing stage before tapping. For recovery of these metal particles, the solidified slag must be pulverized and the resultant powder subjected to magnetic separation.

Owing to the relations shown in FIG. 12 and FIG. 13, the parameter S must fall in the range defined by the following formula.

$$100\ (\text{Nl/min.t}) \leqq S \leqq 1{,}800\ (\text{Nl/min.t}) \quad (3)$$

Figure 4:
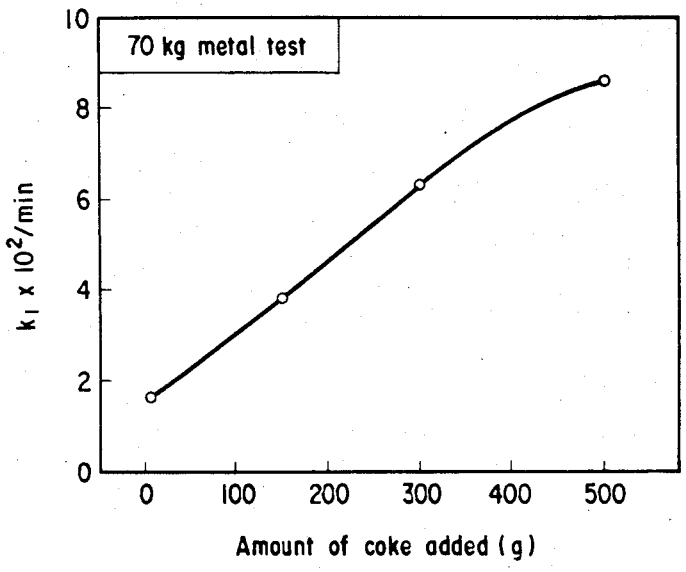
FIG. 4 is a diagram illustrating the effect of the amount of coke added upon the rate constant $k_1$ in the region accountable by the first order reaction as determined by the test using the apparatus of FIG. 2.
Figure 5:
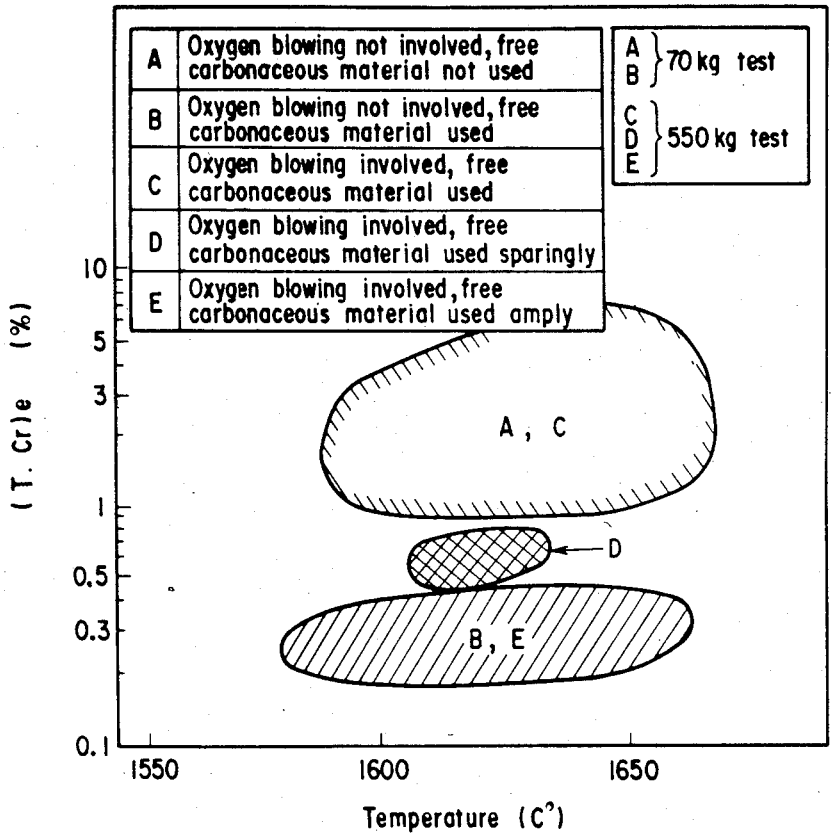
FIG. 5 is a diagram illustrating the effects of presence or absence of oxygen supply, amount of free carbonaceous material, and temperature upon the apparent equilibrium chromium concentration $(T.Cr)_e$ of the slag as determined by the test using the apparatus as of FIG. 1 and FIG. 2.
Figure 14:
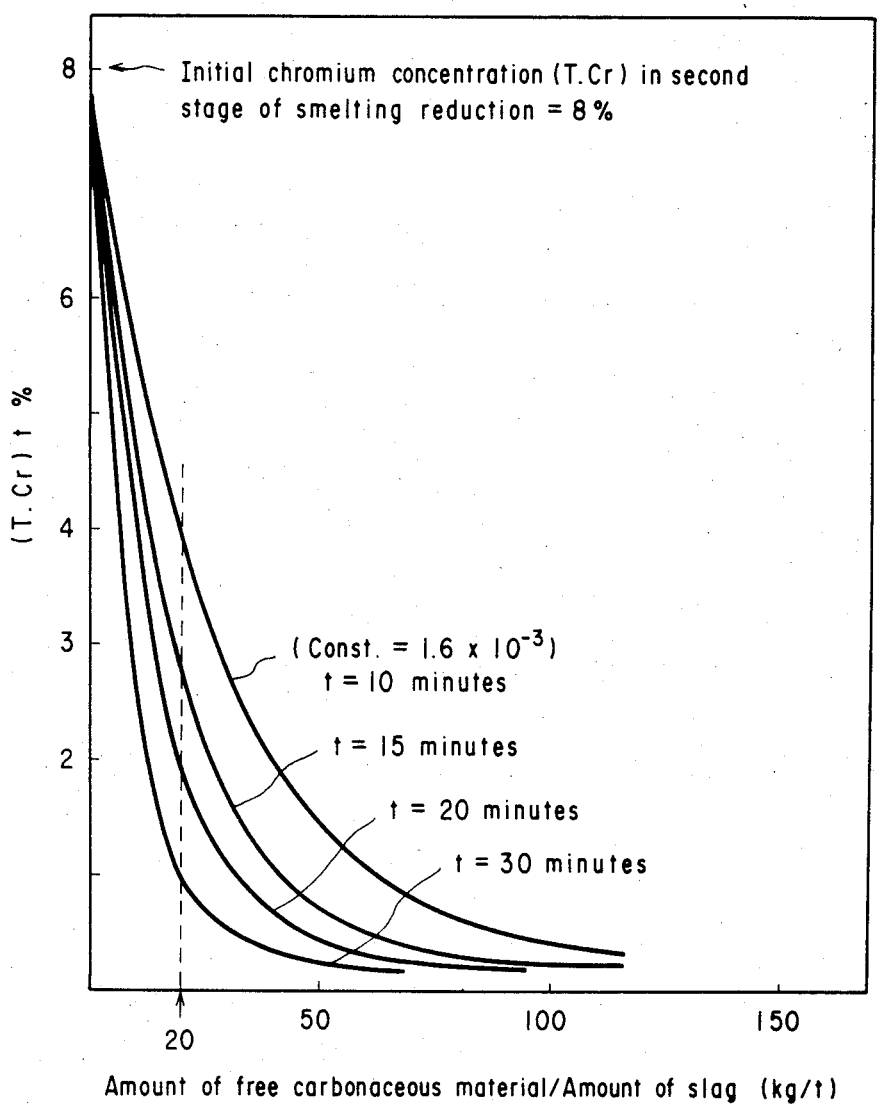
FIG. 14 is a diagram illustrating the effect of $$\frac{\text{amount of free carbonaceous material}}{\text{amount of molten slag}}$$

From the results of the basic test shown in FIG. 4 and FIG. 10, it is noted that the rate of the reduction during this stage of smelting reduction relies on the amount of the free carbonaceous material. Actually, the carbon supplied to the smelting reduction furnace originates in two sources, i.e. the carbon contained in the pellets and the carbon added as a carbonaceous material separately of the pellets. The amount of the former carbon substantially equals to that of carbon dissolved into the reduced metal. Thus, in the approximate sense, the amount of the free carbonaceous material is expressed as the difference obtained by reducing the amount of carbon released in the form of CO or $CO_2$ gas out of the furnace from the amount of carbon in the carbonaceous material supplied to the smelting reduction furnace. The amount of the latter carbon, therefore, ought to be affected by the amount of oxygen introduced by blowing and the CO and $CO_2$ contents of the waste gas (which are determined based on the analyses). For practical purpose, the amount of the free carbonaceous material is defined by the formula (4). The relation of this amount of the free carbonaceous material and the total chromium content (T.Cr%) of the slag at varying intervals is shown in FIG. 14. It is, therefore, self-evident that for the chromium content of the slag to be sufficiently low, the amount of the free carbonaceous material is desired to satisfy the condition of the formula (5).

$$C_F = W_c - 0.54 \cdot \frac{(\bar{a} + \bar{b})}{100} \cdot V \quad (4)$$

-continued $$\frac{C_F\,(\text{kg})}{\text{Amount of slag } (t)} \geqq 20\ (\text{kg}/t) \quad (5)$$

wherein $C_F$ stands for the amount of the free carbonaceous material (kg), $W_c$ for the accumulative value of the carbon in the supplied carbonaceous material (kg), $\bar{a}$ for the integral average of the CO content (%) of the waste gas composition, $\bar{b}$ for the integral average of the $CO_2$ content (%) of the waste gas composition, and V for the accumulative value of the flow volume of the waste gas ($Nm^3$). To be specific, as the free carbonaceous material decreases in consequence of the introduction of oxygen by blowing, the carbonaceous material is supplied by way of replenishment to the smelting reduction furnace via the carbonaceous material hopper 26, for example, to satisfy the formula (5) when necessary.

For the rate of the reduction (namely, the rate of the decrease of the total chromium content of the slag) during the course of this stage to be lowered, the test results of FIG. 8 indicate that the components of the slag should satisfy the condition of the formula (6).

$$\frac{(\%\ \text{CaO}) + 1.39\ (\%\ \text{MgO})}{(\%\ \text{SiO}_2) + 1.18\ (\%\ \text{Al}_2\text{O}_3)} = 0.7 \text{ to } 1.5 \quad (6)$$

$$(\%\ \text{Al}_2\text{O}_3) \leqq 25\%$$

In order that this condition of the components of slag may be satisfied throughout the entire period of the second stage of smelting reduction, the amount of the flux to be added during the first stage of smelting reduction ought to have been adjusted so that toward the end of the first stage of smelting reduction at the latest, the slag has a composition satisfying this condition.

When this condition is satisfied, the chromium content of the slag can be lowered to the prescribed level by continuing the treatment for a required length. For example, the treatment can be continued even to the extent of lowering the total chromium content of the slag below the level of 0.5%.

After the chromium content of the slag has been lowered to the prescribed level, the slag is discharged from the converter and molten metal is tapped. In this case, about one third of the molten metal is left behind as the starting melt. Optionally, after the discharge of the slag, the work of tapping the metal may be omitted and the first and second stages of smelting reduction may be repeated and, thereafter, the molten metal from the two cycles of heating may be tapped at once. The tapped metal, similarly to the ordinary ferrochromium, may be left solidifying and then finely pulverized to afford the final product. Alternatively, the tapped metal still in a molten state may be transported to a steelmaking shop, there to be utilized in the production of stainless steel. In this case, the sensible heat of the tapped metal contributes to lowering the production cost of stainless steel. The discharged slag is left solidifying spontaneously or rapidly cooled with cold water, finely pulverized as occasion demands, and subjected to magnetic separation for recovery of metal particles. The product of this treatment is utilized in various suitable applications. For example, it may be used as filler for reclaimed land, material for roadbed, or soil conditioner.

EXAMPLE

Two top and bottom blowing converters each of a rated capacity for 50 tons of molten metal (the amount of molten metal immediately before tapping from the converter) were used as reactors. They were operated semicontinuously by using partially reduced pellets as the raw material, tapping two thirds (about 33 tons) of the formed ferrochromium, and leaving the remaining one third behind in the furnace. The smelting reduction furnaces were each provided on the furnace bottom with four bottom blowing tuyeres (double tubes having an inner tube diameter of 20 mm). In each of the double tubes, the inner tube was used for passing pure oxygen and the outer tube for passing propane gas as a protective gas. The top blowing lance was provided at the nozzle thereof with a total of seven orifices (one at the center and six spaced circumferentially).

The chromium ore as the main raw material for the smelting reduction was mixed with coke, pulverized, and pelletized. The pellets were dried and then charged in a rotary kiln and, there, subjected to rereduction and preheating with the heat of the hot gas emanating from the smelting reduction furnace. Of the carbonaceous material supplied to the smelting reduction furnace, 80% was supplied to the rotary kiln and used therein for the purpose of improving the ratio of reduction of the partially reduced pellets and preheating the carbonaceous material to be supplied to the smelting reduction furnace. The rotary kiln was continuously operated (with the rotational rate of the kiln at 0.4 rpm and the treated pellets continuously discharged). By the use of a distributing device, the discharged pellets were forwarded to either of the two smelting reduction furnaces.

The average composition of the partially reduced chromium pellets supplied to the smelting reduction furnace and the temperature thereof were as follows.

Total chromium: 35%, total iron: 23%, ratio of reduced chromium: 66%, ratio of reduced iron: 92%, MgO: 10%, $Al_2O_3$: 10%, $SiO_2$: 9%, temperature: 1,300° C.

First stage of smelting reduction

While an oxygen-containing gas was top and bottom blown into 17 tons of the residual melt in the furnace, the preheated pre-reduced pellets were charged into the furnace in conjunction with a carbonaceous material and lime.

The supply of oxygen by blowing was carried out at a rate of 14,000 $Nm^3/hr$ through the top and 1,600 $Nm^3/hr \times 4$ through the bottom. The rate of the supply of the pre-reduced pellets was adjusted so that the temperature of the molten metal phase would be controlled between 1,580° to 1,630° C.

The furnace was charged with 64 tons of the partially reduced pellets, 20 tons of carbonaceous material, and 7.0 tons of coal over a period of 45 minutes. The parameter S of the carbonaceous material supplied to the furnace during this stage remained in the range of 500 to 700, satisfying the condition of the formula (2).

The composition, amount, and temperature of the slag at the end point of this stage were as follows.

CaO: 25%, $SiO_2$: 26%, MgO: 19%, $Al_2O_3$: 19%, total chromium: 6.8%, total iron: 1.1%, amount of slag: 36 tons, temperature: 1,630° C.

The amount of metal was 45 tons and that of the free carbonaceous material 3 tons.

Second stage of smelting reduction

The supply of the partially reduced pellets was discontinued. The carbonaceous material was charged through the carbonaceous material hopper into the smelting reduction converter with three minutes' intervals in a fixed amount of 100 kg. The supply of oxygen by bottom blowing was continued at a fixed rate and that by top blowing was made with five minutes' intervals in varying amounts of 8,500 $Nm^3/hr$, 4,000 $Nm^3/hr$, and 0 $Nm^3/hr$ to promote the reduction of the chromium content of the slag. The metal temperature was kept in the range of 1,600° to 1,630° C. The parameter S remained in the range of 1,200 to 1,500, satisfying the condition of the formula (3).

The ratio of the amount of the free carbonaceous material to that of the molten slag was in the range of 60 to 100 kg/t, also satisfying the condition of the formula (5).

The composition of the final slag of the smelting reduction furnace was as follows: CaO: 28%, $SiO_2$: 28%, MgO: 20%, $Al_2O_3$: 20%, total chromium: 0.6%, total iron: 0.7%. Throughout the entire period of this stage, the components of the slag fell in the following ranges, satisfying the condition of the formula (6).

$$\frac{(\%\ CaO) + 1.39(\%\ MgO)}{(\%\ SiO_2) + 1.18(\%\ Al_2O_3)} = 1.05 \text{ to } 1.15$$

$$Al_2O_3 = 18 \text{ to } 20\%$$

The composition of the metal tapped from the furnace was as follows. Cr: 53%, Fe: 37%, C: 6.5%, Si: 0.5%, S: 0.0015%, P: 0.0035%

In the operation described above, the duration of the first stage of smelting reduction was 45 minutes, that of the second stage of smelting reduction 15 minutes, that of the period of decarburization 20 minutes, and that of the period for discharge of the slag and tapping of the metal was 10 minutes. The period for supply of pellets to each of the smelting reduction furnaces was 45 minutes and the period for suspended supply of pellets was 45 minutes. This time schedule matched well with the operation of one rotary kiln and two smelting reduction furnaces.

In the smelting reduction process of chromium oxide such as chromium ore described above, the occurrence of such gases as $SO_x$ and $NO_x$ detrimental to the preservation of good environment in the system must be curbed to the fullest possible extent. From the results of numerous tests, the inventors have acquired the following knowledge and established the most desirable operational pattern for the process.

The knowledge mentioned above pertains a smelting reduction process for producing ferrochromium by treating molten iron, pre-reduced chromium ore pellets, a carbonaceous material, and oxygen in a reactor adapted to permit top and bottom blowing of an oxygen-containing gas, which process adopts a basic operational pattern having a stage of smelting reduction (supply of raw materials to the converter), a stage of finishing reduction, and a stage of discharge of slag and tapping of metal (with retention of starting melt) constitute a unit cycle and, in the aforementioned stage of smelting reduction, carries out the treatment in the presence of a layer of slag of a thickness not greater than 1000 mm but sufficient for precluding passage therethrough of any metal splash of the molten metal held within the converter while maintaining the slag in a composition satisfying the condition of $Al_2O_3<21\%$ or $(Al_2O_3)+(MgO)<47\%$, adding a flux so as to keep the $CaO/SiO_2$ ratio in the range of 0.7 to 1, controlling the ratio of secondary combustion below 50%, and maintaining the amount of coke in the furnace within a range defined by the formula: (weight of coke)/(weight of slag)=0.1 to 0.2.

Now, the process will be described in detail.

In the smelting reduction process of chromium oxide such as chromium ore contemplated by this invention, the stage of smelting reduction (supply of raw materials to the converter), the stage of finishing smelting reduction, and the stage of discharge of slag and tapping of metal (with retention of starting melt) constitute a unit cycle.

The thickness of the slag layer must be enough to preclude passage therethrough of any metal splash. It can be somewhere in the range of 500 to 600 mm.

The flux is added in such an amount that the slag composition has $Al_2O_3$ in a concentration not exceeding the upper limit determined by the temperature. At 1,600° C., for example, the $Al_2O_3$ content is less than 21% or the combined content of $Al_2O_3$ and MgO is less than 47%.

From the standpoint of facility of the reaction, the basicity of the slag in the converter can be selected in a wide range. To preclude the phenomenon of foaming and enhance the transfer of heat from above, the basicity expressed as $CaO/SiO_2$ is optimum in the range of 0.7 to 1.0.

As a source of flux, the slag issuing from the steelmaking operation may be used on condition that it has a sufficiently low phosphorus content.

Then, the ratio of the secondary combustion can be controlled in a wide range owing to the combustion of the condition of oxygen blowing and the amount of coke present. According to the results of the test conducted by the inventors, a close correlation exists between the ratio of the secondary combustion and the amount of $SO_x$ generated or the amount of $NO_x$ generated as shown in FIG. 15 and FIG. 16. These test results indicate that the ratio of the secondary combustion is desired to be not more than 50%.

The rate of the reduction of chromium increases in proportion as the amount of coke present within the reactor for the smelting reduction increases. If the amount of coke is so large as to elongate the retention time of coke on the slag surface, however, the amounts of $NO_x$ generated under a fixed ratio of the secondary combustion will increase.

All the factors described above indicate that the amount of coke present in the converter is optimum in the range of (weight of coke present)/(weight of slag)=0.1 to 0.2, although this range is variable somehow with the condition of stirring of the slag-metal melt.

The high-chromium alloy obtained by the stage of pre-reduction performed on chromium oxide such as chromium ore and the subsequent stage of smelting reduction performed on the pre-reduction product emanating from the preceding stage has a silicon content of less than 0.5% and, therefore, is a low-silicon chromium alloy.

The high-chromium alloy of a low silicon content so produced can be directly transported in its molten state to a steelmaking plant and used for production of stainless steel conveniently owing to the utility of the sensible heat possessed by itself.

When the high-chromium alloy is elected to be solidified and then crushed to obtain a finished product, it is desirable to promote thorough deoxidization of ferrochromium during the stage of smelting reduction so far described, by allowing the smelting reduction to proceed until the oxide content of the slag falls below 1%, then pouring a Si alloy having a silicon content in the range of 20 to 75% downwardly into the slag to be melted therein, causing the resultant melt of the Si alloy to capture fine chromium particles present in the slag and precipitate into the molten metal in the converter.

The slag by-produced in the process of smelting reduction of chromium oxide such as chromium ore by this invention possesses a composition as shown below.

$$\frac{(CaO\ \%) + 1.39(MgO\ \%)}{(SiO_2\ \%) + 1.18(Al_2O_3\ \%)} = 0.7 \text{ to } 1.5,$$

$Al_2O_3=17$ to 25%, and Cr content of slag $\leqq 1.0\%$

The slag of this composition is highly useful as material for road bed and other similar structures and as a soil reconditioner.

Within the smelting reduction furnace, generation of heat is effected by combusting the solid carbonaceous material with oxygen or an oxygen-containing gas introduced through the top blowing lance. Success of the process of the present invention hinges heavily on how the efficiency of the oxygen in the combustion is improved and how the rate of the generation of heat is increased.

In the process of this invention for the smelting reduction of chromium oxide such as chromium ore, the solid carbonaceous material which functions as heat source or as a reducing agent is mixed with powdered chromium ore, for example, pelletized, and partly introduced into the system of pre-reduction in the rotary kiln and partly poured onto the slag-metal melt in the smelting reduction furnace.

The inventors have further created a process for inexpensively and efficiently effecting reduction treatment on the chromium element contained in the slag, dust, sludge, etc. by utilizing the outstanding reducing ability of the process of this invention for the smelting reduction of chromium oxide.

To be specific, this process is for the treatment of a chromium oxide-containing by-product occurring during the production of stainless steel, which comprises feeding the by-product in conjunction with a carbonaceous material into a top and bottom blowing converter operated with the slag/metal weight ratio kept above 0.2 and introducing oxygen into the converter by blowing thereby recovering chromium from the by-product by reduction.

Now, this process will be described in detail below.

This process effects inexpensive and efficient reduction of chromium oxide-containing by-products such as slag, dust, and sludge occurring in the production of stainless steel so as to recover chromium from the by-products and consequently lower the chromium content of the by-products to a notable extent before they are discharged from the system.

During the production of stainless steel, part of chromium passes into the slag and dust and converts itself into its oxide. During the stage in which stainless steel is obtained by placing ferrochromium in a converter and preparing therein crude melt of stainless steel (which is a high-chromium molten steel ready for finishing decarburization), transferring this molten steel in a ladle, and blowing the molten steel with oxygen under a vacuum until the C content thereof is lowered to a prescribed level, for example, 5 to 7% of the chromium used passes into the slag occurring in the converter and into the slag and the dust occurring in the stage of finishing decarburization. The reductive recovery of chromium oxide by the addition of a Fe-Si alloy to the slag has been adopted as one of the means of lowering the chromium content in the slag. The act of reducing the molten metal by the use of an expensive reducing agent prior to the finishing decarburization, for example, can not be called rational because it is effective solely in recovering chromium from the slag (the effect of deoxidization of the molten metal does not remain because the molten metal is again oxidized during the finishing decarburization). If a method is available which permits reductive recovery of chromium through inexpensive treatment of the chromium-containing by-products, then this inefficient deoxidization during the intermediate stage can be omitted. An attempt to enhance the productivity of stainless steel manufacture inevitably increase the chromium content of the slag and the occurrence of dust after oxygen blowing.

Besides the slag and the dust which occur during the stage of steelmaking as described above, the stage of casting and the subsequent stages give rise to scale, scraps of cutting, debris from gas cutting, and sludge from pickling which invariably contain chromium preponderantly in the form of oxide. No method has ever been developed for efficient treatment of such chromium-containing by-products.

(i) An attempt to effect reductive recovery of chromium by independent treatment of the slag which has a relatively low chromium content of 10% or less fails as uneconomical because the slag/metal weight ratio of the product of this treatment is excessively extreme.

(ii) In the case of dust, scale, and scraps of cutting which have relatively high chromium contents, an attempt has been made recover chromium from such by-product by molding the by-product in a prescribed shape, placing the molded pieces in an electric furnace, and reducing them with a carbonaceous material. Since, in this case, the treatment is performed on a small scale by the use of expensive electric power, it entails a problem that both equipment cost and variable cost are huge.

It is, therefore, highly desirable to effect reductive recovery of chromium from all the by-products mentioned above by making effective use of the properties possessed by such by-products, utilizing existing facilities for the production of stainless steel or some other high-chromium alloy, and using inexpensive reducing agent and energy and, as the result, lower notably the chromium contents of the by-products before they are discharged from the system. Development of a method is capable of this very treatment has been longed for.

The present invention has issued from the various studies continued with a view to perfecting the method just mentioned. It resides essentially in a process for the treatment of a chromium oxide-containing by-product occurring in the production of stainless steel, characterized by the steps of placing the by-product in conjunction with a carbonaceous material in a top and bottom blowing converter operated with the slag/metal weight ratio kept above 0.2, blowing oxygen into the molten metal in the converter, reducing chromium present in the by-product, and recovering the reduced chromium.

Now, the present invention will be described in detail below with reference to a working example.

First, the process adopted during the stage of production of stainless steel will be described.

When the production of stainless steel is carried out in a top and bottom blowing converter, the amount of slag formed in such that the slag/metal weight ratio is not more than 0.15. Under the conventional steelmaking condition, since the loss of chromium in the slag increases with the increasing amount of the slag, it is generally held wise to minimize the amount of slag to what is inevitably produced owing to the addition of flux such as lime to the by-product (such as $SiO_2$ produced by the oxidation of the Si content of ferrochromium) which is inevitably required for the purpose of refining of the molten metal and for the protection of the lining.

In accordance with the test results shown in FIG. 24, this invention contemplates effecting the reductive recovery of chromium by intentionally increasing beyond a prescribed lower limit the amount of slag to be formed under proper peripheral conditions and enhancing the efficiency of the recovery of chromium oxide by the reduction thereof with carbon.

With reference to FIG. 24, the proper operating conditions are as follows.

(i) Hard stirring is effected by bottom blowing of oxygen.

Since the reduction of the chromiun oxide (including chromium oxide added to the converter as raw material and chromium oxide formed by reoxidization of the molten metal by oxygen blowing) is retarded when the stirring is not sufficient, the chromium content in the slag increases past the curve of FIG. 24 if the slag/metal weight ratio is increased.

(ii) Free carbonaceous material coexists in the slag.

The free carbonaceous material such as, for example, coke lump undergoes partial oxidation with evolution of heat and constitutes itself an active reaction site for the reduction of the chromium oxide in the slag.

The fact that the free carbonaceous material coexists in the slag when the slag/metal weight ratio is below 0.3 implies that the molten metal is consequently in a state saturated with carbon. When the amount of the slag is increased further, direct contact between the free carbonaceous material and the molten metal can be obstructed even under hard stirring and, consequently, the carbon content of the molten metal can be lowered to a level of unsaturation. When the slag/metal weight ratio is below 0.15, the chromium content of the slag is high even in the presence of the free carbonaceous material. This is because the jet of oxygen blown through the top impinges upon the surface of the molten metal and reoxidization of chromium proceeds simultaneously. When the amount of slag increases and the slag/metal weight ratio increases past 0.2, the reoxidization of the molten metal by the top blown oxygen jet is prevented and the chromium content of the slag is stablized at a low level.

Now, a typical operation utilizing the conditions shown in FIG. 24 for lowering the chromium content of the slag will be illustrated below.

In the production of stainless steel in the top and bottom blowing converter (particularly where the melting of raw materials and the primary decarburization are carried out for the preparation of the molten metal for the subsequent stage of finishing decarburization), generally the slag formed by two or more cycles of heating in the ordinary operation is treated under special conditions fit for one-cycle heating. The slag formed by the ordinary heating may be left standing within the converter or it may be discharged from the converter once and then returned into the converter. The dust, sludge, scraps of cutting, etc. are accumulated to a suitable total volume, molded in the form of pellets or briquets, and stored in a dry form. When these pellets or briquets incorporate a carbonaceous material such as powdered coke during the course of molding, they prove convenient in the sense that they permits a decrease in the time required for the reduction. The production of stainless steel under the aformentioned special conditions means an operation of blending the ordinary raw materials for stainless steel (molten pig iron, ferrochromium, scraps, and lime) with the slag and the molden pieces of such by-products as dust, scraps of cutting, and sludge, and a carbonaceous material such as coke in proportions such that the slag/metal weight ratio will exceed 0.2. The amount of the carbonaceous material such as coke is determined as the sum of the amount of carbon to melt into the molten metal, the amount required for reducing the oxides of chromium and iron in the raw materials charged in the converter, the amount required for the combustion up to the extent of CO or $CO_2$ to permit supply of heat for the reductive reaction, and the amount required for the combustion up to the extent of CO or $CO_2$ to permit supply of sensible heat to meet an increase of the amount of cold materials introduced as compared with the ordinary operation. In actuality, however, the amount of the carbonaceous material such as coke which is required is variable because the ratio of the CO and $CO_2$ contents of the waste gas are varied by the operating condition of the converter in use.

By continuing the top and bottom blowing of oxygen and the consequent hard stirring of the melt, the reduction of chromium oxide is made to proceed to a prescribed extent (which is determined by the method by which the slag discharged out of the system is utilized) such as, until the chromium content of the slag falls below 0.5%. The chromium content of the slag is controlled by selecting the duration of the oxygen blowing and the temperature, for example. After the total chromium content has been lowered to the prescribed level, the converter is tilted to discharge the slag. After the greater part of the slag has been so discharged, the oxygen blowing is continued to lower the carbon content of the molten metal to the level which is desired for the sake of the subsequent stage. Thus, this method is characterized by the fact that supply of the slag required in an amount larger than the amount normal to the conventional method for the efficient reduction of the chromium oxide in the slag by the blowing of oxygen and by the use of inexpensive means of coke is ensured by accumulation of slag, dust, etc. produced by two or more cycles of heating.

The process for effecting reductive recovery of chromium by treating the chromium oxide-containing by-product in the stage of stainless steel production has been described. Otherwise, the process may be applied to the stage of production of ferrochromium. When chromium ore of carbon-containing partially reduced chromium pellets prepared from powdery chromium ore are charged in conjunction with carbonaceous material and flux to a top and bottom blowing converter and oxygen is introduced therein by blowing to effect the reduction of chromium oxide by utilizing the exothermic reaction, $C+O \rightarrow CO$ or $C+O_2 \rightarrow CO_2$, for example, the chromium oxide-containing by-product occurring during the state of stainless steel production to be used as the starting material for the process in question offers the following advantage.

(i) It contains chromium oxide, the object of reductive recovery.

(ii) The CaO and $SiO_2$ entrained by the by-product can serve as substitutes for the lime and the quartzite added as slag forming agents during the stage of smelting reduction of ferrochromium. The slag forming agents added during the stage of smelting reduction of ferrochromium play the part of altering the composition of the $MgO—Al_2O_3—SiO_2$ type gangue in the chromium ore and rendering the viscosity, melting point, etc. of the formed slag suitable for smelting reduction. CaO, $SiO_2$, etc. are added for the purpose of lowering the proportions of $Al_2O_3$ and other components which adversely affect the smelting reduction below tolerable limits. Incidentally, the slag occurring during the stainless steel production entrain CaO and $SiO_2$ in large amounts and contain such detrimental components as $Al_2O_3$ in small amounts and, therefore, serves advantageously as flux. The large contents of CaO and $SiO_2$, further, bring about an effect of more quickly effecting formation of slag than by external addition of quick lime, for example.

(iii) When the dust, scraps of cutting, sludge, etc. are in powdery form or in the form of sludge in water, they can be blended readily with powdery chromium ore during the preparation of carbon-containing chromium pellets.

As described above, the chromium oxide-containing by-products occurring during the stage of stainless steel production are invariably quite malleable as secondary raw materials during the stage of smelting reduction of ferrochromium. During the stage of smelting reduction of ferrochromium in the top and bottom blowing converter, there is formed a large amount of slag having a slag/metal weight ratio exceeding 0.3 owing to MgO, $Al_2O_3$ and $SiO_2$ components entrained by the chromium ore. When the hard stirring by the bottom blowing, the addition of carbonaceous material, and the efficient generation of heat due to the top blowing are utilized in this case, the reductive recovery of chromium oxide can be promoted and the chromium content of the discharged slag can be easily lowered to a low level below 1%.

EXAMPLE (1) Process applied to the stage of stainless steel production:

The following raw materials were charged in a top and bottom blowing converter having a rated capacity of 150 tons.

| | | |
|---|---|---|
| Molten pig iron | 70 t | Pretreated externally to P = 0.01% (C: 4.7%, Si: 0.01%, S: 0.005%, 1280° C.) |
| Ferrochromium | 32 t | Cr: 55%, Si: 2%, P: 0.030%, S: 0.020% |
| Scraps | 17 t | Average composition: Cr: 4%, C: 0.04%, P: 0.028%, S: 0.010% (balance Fe) |

-continued

| | | |
|---|---|---|
| Slag formed during stainless steel production | 30 t | Average composition: CaO: 58%, $SiO_2$: 20%, MgO: 9%, $Al_2O_3$: 1%, T.Cr: 6%, T.Fe: 3% |
| Lime | 10 t | CaO: 95% |
| Briquets formed by mixing dust, scraps of cutting, and sludge with carbonaceous material, molding the mixture, and drying | 15 t | Average composition: T.Cr: 9%, FeO: 55%, $Al_2O_3$: 3%, CaO: 8%, C: 15% |
| Coke | 20 t | C: 88%, S: 0.07% Grain size 20 to 55 mm |

By introducing oxygen at a top blowing rate of 3,900 $Nm^3$/hr and a bottom blowing rate of 4,000 $Nm^3$/hr for 60 minutes, there were obtained 140 tons of metal composed of 17% of Cr, 77% of Fe, 5% of C, 0.040% of P, and 0.025% of S and having a temperature of 1,520° C. and 42 tons of slag having a total chromium content of 0.5% and a total iron content of 0.3% (slag/-metal=0.34). At this point, the converter was tilted to discharge 90% of the slag. Then, the top and bottom oxygen blowing was continued until C: 0.5% and temperature: 1,650° C. Subsequently, the steel was tapped into a ladle and blown with oxygen under a vacuum to effect finishing decarburization to C: 0.04%.

(2) Process applied to the stage of ferrochromium production:

A top and bottom blowing converter (provided with six bottom blowing tuyeres) having a rated capacity for 100 tons of molten metal was operated to tap 60 tons each of ferrochromium (containing 55% of Cr, 0.1% of Si, and 8% of carbon) at intervals of about three hours. To 20 tons of the residual metal from the preceding cycle of heating, the following raw materials were added.

(i) Partially reduced pellets:

One hundred (100) parts by weight of powdered chromium ore, 2 parts by weight of dust (T.Cr: 25%) occurring during the stage of stainless steel production, 2 parts by weight of sludge (T.Cr: 18%), and 2 parts by weight of scraps of cutting (T.Cr: 9%) were mixed. The mixture was blended with powdered coke, pelletized, and preheated and pre-reduced with the gas issuing from the top and bottom blowing converter. The pre-reduced pellets (composed of 32% of total Cr, 19% of total Fe, 11% of MgO, 12% of $Al_2O_3$, 2% of CaO, and 9% of $SiO_2$; pre-reduction ratio of chromium 55%) were charged piecemeal at a rate of 2 tons/min over a period of about 60 minutes.

(ii) Carbonaceous material:

Substantially parallelly with the aforementioned partially reduced chromium pellets, 45 tons of coke (C content: 88%, grain size: 20 to 50 mm) was added.

(iii) Slag occurring during the stage of stainless steel production:

The produced slag composed of 58% of CaO, 20% of $SiO_2$, 9% of MgO, 1% of $Al_2O_3$, 6% of total Cr, and 3% of total Fe was ground to a grain size of less than 50 mm was charged piecemeal, in an amount of 13.5 tons, parallelly with the aforementioned partially reduced chromium pellets from above the converter.

(iv) Lime:

Parallelly with the slag of (iii), 7.5 tons of lime having a CaO content of 97% (grain size: 20 to 50 mm) was charged piecemeal.

For a period of about 60 minutes, the introduction of oxygen was carried out at a top blowing rate of 23,000 $Nm^3$/hr and a bottom blowing rate of 4,500 $Nm^3$/hr. For 30 minutes after completion of the introduction of various chromium-containing raw materials and subsequent piecemeal addition of 4 tons of coke, the introduction of oxygen was carried out at a top blowing rate of 15,000 $Nm^3$/hr and a bottom blowing rate of 4,500 $Nm^3$/hr to effect finishing reduction and produce in the converter 61 tons of slag composed of 26% of CaO, 24% of MgO, 23% of $Al_2O_3$, 25% of $SiO_2$, 0.7% of total Cr, and 0.5% of total Fe and 60 tons of ferrochromium (slag/metal weight ratio: 1.02). At this point, the slag was discharged and two thirds of the molten metal was tapped.

As described above, the present invention, by making the most of the characteristic of the chromium-containing by-products occurring in the stage of stainless steel production (relatively low chromium content and effectiveness in formation of slag), enables reductive recovery of chromium to be effected in high efficiency by the use of inexpensive carbonaceous material in the top and bottom blowing converter adopted for the production of stainless steel or ferrochromium and lowers notably the chromium content of the by-products discharged out of the system. Thus, it brings about a great economic effect in rationalizing the stage of stainless steel production, enhancing the utility of chromium resources, and contributing to the preservation of good environment.

Then, for the purpose of carrying out the smelting reduction of chromium oxide such as chromium ore with high efficiency and lowering the amount of chromium oxide in the slag as contemplated by the present invention, it is necessary to accelerate the motion of the carbonaceous substance and increase the number of effective reaction sites.

As means of accomplishing this necessity, the inventors have created the following processes.

(1) A process for the smelting reduction of a ferrous alloy by a procedure of supplying raw materials incorporating iron oxide, carbonaceous material, flux, and an oxidizing gas to a converter capable of top and bottom oxygen blowing, melting and reducing the oxide and separating the consequently formed metal, which procedure further comprises blowing at least part of the iron oxide-containing raw material against the slag through a top blowing lance to increase the amount of carbon-containing metal particles present in the slag and promote the smelting reduction.

(2) A process for the smelting reduction of a ferrous alloy by a procedure of supplying raw materials incorporating iron oxide, carbonaceous material, flux, and an oxidizing gas to a converter capable of top and bottom oxygen blowing, melting and reducing the oxide and separating the consequently formed metal, which procedure further comprises throwing scraps having a bulk specific gravity of not more than 5 down on the slag to increase the amount of carbon-containing metal particles present in the slag and promote the smelting reduction.

Now, these processes will be described in detail below. In this invention, the task of causing the smelting reduction of the iron oxide-containing raw materials to proceed at a high rate in the top and bottom blowing converter while repressing the damage to the lining has been fulfilled by increasing the amount of carbon-containing metal particles present in the slag.

The rate of the reduction of an oxide is determined by the process of the reduction or the process of supply of heat for the reduction. First the rate of the reduction increases in proportion as the temperature rises, the oxide concentration of the relevant component in the slag increaes, and the area occupied by the reduction of the oxide increases. Because of the aforementioned necessity of repressing the damage to the lining, the temperature and the oxide concentration of the component (particularly FeO) have their own upper limits. The present invention, therefore, has sought solution in increasing the area to be occupied by the reduction of the oxide. The places which are generally regarded as seats for the reduction of the oxide within the smelting reduction converter are the molten metal containing carbon and the surface of the free carbonaceous material. Where the slag layer 51 overlies the molten metal 53 as illustrated in FIG. 17-(1), any effort to maintain the rate of reaction in the slag-metal interface at a high level has its limit no matter how powerfully the melt be stirred. The rate of the reaction decreases in proportion as the scale of the reduction is increased. If the molten metal is to be utilized as a potential site for the reduction, one possible way of doing so may reside in blowing the raw material containing the oxide to be reduced in the form of powder into the molten metal 53. Indeed, the area in which the reaction is caused can be increased by this method. This method, however, entails the following problems.

(i) Since the amount of the powdered raw material to be blown in is large, the device used for the blowing is proporionately large and expensive and the piping used therefor is susceptible of heavy wear and necessitates exacting maintenance.

(ii) Within the converter, the heat of the reaction of $C \rightarrow CO$ is barely available. This is because the heat of the reaction of $CO \rightarrow CO_2$ occurs exclusively in the upper space within the converter and, where the slag of a large thickness (particularly with bubbles) intervenes between this empty space and the molten metal, this heat of the reaction is transferred to the seat of the reduction with great difficulty.

If the problem of equipment attendant upon this method is solved and the blowing of powdered raw material is carried out effectively, the productivity of the method is restrained because the rate of reaction is governed by the supply of heat and the temperature of the metal is consequently lowered.

The act of intensifying the stirring by the top and bottom oxygen blowing to expand the area in which the carbonaceous material is distributed within the slag layer 51 or blowing powdered carbonaceous material into the slag as illustrated in FIG. 17-(3) is effective in heightening the rate of the reduction to some level. This effect, however, is saturated and is not sufficient for the materialization of the high productivity aimed at by this invention. This is because the thoroughness with which the carbonaceous material having a lower specific gravity than the slag is dispersed in the molten slag has its limit.

The present invention, therefore, elects to increase the area of contact between the slag and the sites of the reduction by increasing the amount of carbon-containing metal particles present within the slag. Specifically, the increase mentioned above is accomplished by blowing part of the iron oxide-containing raw material in a powdery form into the slag while keeping the top oxygen blowing of the converter capable of hard stirring with a bottom blown gas to effect required smelting reduction or by throwing scraps having a bulk specific gravity not exceeding 5 down on the slag while keeping the top oxygen blowing of the converter similarly capable of hard stirring with a bottom blown gas to effect smelting reduction.

A typical converter to be used for smelting reduction is illustrated in FIG. 18.

In the diagram, 61 denotes a rotary kiln, 62 a smelting reduction converter, 63 a tuyere, 64 a top blowing lance, 65 a hood, 66 a hopper for carbonaceous material and flux, 67 metal, 68 slag, 69 chromium pellets, 70 carbonaceous material, 71 bubbles, and 72 a powdered raw material blowing lance.

The smelting reduction converter 62 is supplied with raw material consisting mainly of iron oxide-containing ore or the ore heated and pre-reduced outside the converter. It melts the raw material, promotes reduction on the residual iron oxide and other metals (such as chromium and manganese) desired to be recovered, and separates the formed slag and metal. It is provided with the tuyere 63 (possibly a plurality of such tuyeres) for blowing an oxygen-containing gas through the bottom and the lance 64 for blowing oxygen into the converter through the top.

The bottom blown gas is important in the sense that it causes hard stirring of the metal and the slag and promotes the reduction. In the present invention, the hard stirring is effected particularly with metal particles suspended in the slag essentially for the purpose of enhancing the contact between the metal particles and the carbonaceous material, increasing the chance of absorption of carbon by the metal particles, and enabling the surface of the metal particles to constitute an effective site for reaction.

Purely for the purpose of stirring, the gas is not necessarily required to contain oxygen. If any gas other than oxygen (such as $N_2$ or Ar) is used at all, the gas is required in a large amount (particularly for producing desired hard stirring when the amount of slag formed is large). This gas, therefore, proves disadvantageous in terms of cost and heat. Thus, use of an oxygen-containing gas is rational. (When pure oxygen is used. The tuyere is desired to be in a double-tube construction which permits use of hydrocarbon for the protection of the tuyere.) The introduction of an oxygen-containing gas by bottom blowing has an additional effect of enabling control of the temperature of the molten metal and control of the carbon content of the molten metal.

The supply of oxygen through the top blowing lance 64 is mainly for the purpose of enabling the lumpy carbonaceous material (such as coke) thrown in through the top of the converter to be burnt ($C \rightarrow CO$ or partly $C \rightarrow CO_2$) with evolution of heat. It constitutes one main heat source for the present refining process.

In the present invention, the carbonaceous material constitutes itself a reducing agent for the oxide and partly undergoes oxidation with evolution of heat to provide energy for the smelting reduction. The greater part of the carbonaceous material is supplied in a lumpy form into the converter through the top. This is because the addition of the carbonaceous material is effected most easily in this manner. Part of the carbonaceous material may be added in a powdery form by top blowing, by immersion blowing, or by bottom blowing. Addition of the carbonaceous material wholly in a powdery form is not advantageous for the purpose of this invention because it causes carburization of metal particles present in the slag and facilitates the reduction. For the present invention, it is a prerequisite that the greater part of the carbonaceous material is added in a lumpy form and is distributed within the slag in a manner determined by the condition of slag stirring.

When part of the iron oxide-containing powdered raw material is blown onto the upper surface of the slag 68 through the powdered raw material blowing lance 72 in the condition described above, the powder forces its way into the slag by virtue of inertia. At the same time, the powder generates an action of causing part of the carbonaceous material (coke) dispersed above the slag to be pushed down into the slag. The powder so blown into the slag is melted and reduced by the slag to give rise to fine metal particles within the slag. In the slag which is in a hard stirred state, the metal particles come into contact with the carbonaceous material (coke, for example), absorb carbon, and give rise to effective sites for the reduction.

When the raw material in a powdery form is blown in, the retention time of metal particles within the slag is longer and the promotion of the reduction through the aforementioned mechanism is more effective than when the iron oxide-containing raw material is wholly supplied in a lumpy form. The effect in the promotion of the reduction is evaluated by analyzing the progress of the reduction in accordance with the formula of primary order reaction and comparing the rate constant. In this case, the activation energy for the reduction is about 25 Kcal/mol in the case of iron and about 90 Kcal/mol in the case of chromium. Based on the relation between these two rates, the effect in the promotion of the reduction may be converted to the effect in lowering the operating temperature.

The amount of metal particles present in the slag increases in proportion as the proportion of the raw material blown in a powdery form increases. The effect of the addition of the raw material in the powdery form, however, is decreased because the proportion of metal particles liable to conglomerate and settle down increases with the increasing amount of metal particles.

The effect produced on the promotion of reaction by the ratio of pre-reduction of the iron component in the iron oxide-containing powdered raw material ready for blowing is illustrated in FIG. 20. The efficiency is particularly prominant when the ratio of pre-reduction of the iron component falls in the range of 30 to 90%. The data indicate that the raw material for blowing is desired to have been pre-reduced outside the furnace. When the raw material contains no iron oxide (as when pure metal powder is contained), this raw material is not merely expensive but undesirable because the metal particles, when blown in, conglomerate and have a short retention time in the slag.

By so increasing the number of sites for the reduction, the reaction temperature required for obtaining a prescribed rate of reduction can be lowered to fulfil the object of the present invention. In the process of the present invention which makes use of the top and bottom blowing converter, finishing reduction can be carried out by continuing the oxygen blowing and the hard stirring of the melt after completion of the addition of a prescribed amount of raw materials to the converter. This method proves effective when the raw material include a metal less susceptible to reduction than iron or when the amount of metal oxide in the slag is desired to be notably lowered.

For the protection of the tuyere, the operation of the converter has to be carried out as follows. Each time the formed metal is to be tapped, part of the metal (one third, for example) is left standing in the converter and fresh raw material is added to the residual metal. By continuing the smelting reduction in this manner, the amount of metal is increased.

A desired increase in the amount of carbon-containing metal particles present in the slag can be effected by a means of throwing metal such as scraps into the converter through the top beside the aforementioned means. In this case, the scraps charged into the converter melt with heat, come into contact with the carbonaceous material and absorb carbon and, during its motion in the slag, promote the reduction of the iron oxide in the slag or the oxide of a metal to be recovered. In this case, the effect in the promotion of reaction relies on the bulk specific gravity of the scraps (FIG. 21). When the bulk specific gravity of the scraps is excessively large, the scraps melt below the slag and find no ample time for absorbing carbon. Consequently, the metal particles fail to constitute themselves effective sites for reaction.

EXAMPLE (1) In a top and bottom blowing converter having a rated capacity (i.e. the amount of molten metal immediately prior to tapping) for 80 tons of molten metal, iron melt containing 3% carbon was prepared by using iron oxide pellets pre-reduced outside the converter and iron oxide powder pre-reduced by fluidized-bed reduction as raw materials for iron and lumpy coke as a carbonaceous material.

| Kind of raw material | Size | Component | Manner of addition |
|---|---|---|---|
| Pre-reduced iron oxide pellets | 8 to 15 mm in Dia. | T.Fe 72.5% Ratio of reduction of Fe component 80% | Continuously fed from rotary kiln as kept hot into smelting reduction furnace |
| Iron oxide powder reduced in fluidized bed | 200 mesh max. · 70% | T.Fe 70.3% Ratio of reduction of Fe component 52% | Blown onto slag surface at room temperature with $N_2$ carrier gas from a distance of 50 cm above. |
| Carbonaceous material, coke | 10 to 70 mm in Dia. | T.C 88% | Continuously fed from rotary kiln as kept hot in conjunction with iron oxide pellets. |

The operation was carried out semi-continuously by leaving behind one third of the formed metal.

The smelting reduction converter was provided on the converter bottom with four double-tube bottom blowing tuyeres (20 mm in inside diameter). In each of the tuyeres, the inner tube was used for passage of pure oxygen and the outer tube for propane gas as a protective gas. The top blowing lance was provided with a total of seven orifices (one central orifice and six circumferentially spaced orifices).

First stage of smelting reduction

While continuing the introduction of an oxygen-containing gas was by top blowing into 26 tons of residual melt, pre-reduced iron oxide pellets and powdered iron oxide were continuously supplied at a varying ratio indicated in the following table. The concentration of iron oxide in the slag varied substantially within the range of 4 to 8%. The oxygen was introduced at a top blowing rate of 9,000 $Nm^3/hr$ and a bottom blowing rate of 800 $Nm^3/hr \times 4$. When the proportion of powdered iron oxide to the total iron-containing raw material was increased to the following three levels, the variation of the iron oxide concentration in the slag was substantially the same and the metal temperature could be lowered as shown in the following table (the slag temperature was substantially equal because of the hard stirring).

| Proportion of pre-reduced powdered iron oxide to total iron supplied | Metal temperature |
|---|---|
| (a) 0% | 1,550° C. |
| (b) 5% | 1,510° C. |
| (c) 10% | 1,480° C. |

Second stage of smelting reduction

After the iron-containing raw material had been supplied in a prescribed total, the introduction of oxygen (at a top blowing rate of 8,500 $Nm^3/hr$ and a bottom blowing rate of 800 $Nm^3/hr$) was continued at the temperature indicated in the foregoing table for 10 minutes. Consequently, the concentration of iron oxide in the slag fell to 0.5%.

(2) The procedure of the preceding example was substantially followed, except that ordinary steel scraps (press scrap) having a bulk specific gravity of 3 to 4 were used in the place of powdered iron oxide reduced in advance in a fluidized bed. When the proportion of the iron from the scraps to the total amount of iron supplied was 20%, the effect was substantially the same as in the case of (C) of the preceding example.

The unit ratio of the lining could be lowered to 55% by lowering the metal temperature by 70° C.

As described above, according to the present invention the damage to the lining of the converter encountered in operation of the smelting reduction using the top and bottom blowing converter can be avoided by increasing the metal particles present in the slag and promoting the reducing reaction at low temperature. The present invention, therefore, enjoys a great economic advantage in the sense that it permits production of ferrous metals of higher quality at a lower cost than the conventional method using a shaft type reaction furnace.

On the other hand, the phosphorus content of stainless steel is required to be as small as permissible. Phosphorus contained in the stainless steel is undesirable because the phosphorus impairs the resistance to stress-corrosion cracking, corrosion by sulfuric acid, and intergranular corrosion of the stainless steel.

Further, the presence of phosphorus in the stainless steel is detrimental to the chemical and physical properties of stainless steel because the phosphorus harms not workability, heightens transition temperature, and degrades ductility. During the production of stainless steel or during the production of chromium-containing steel, therefore, phosphorus must be removed.

Separately of the present invention, the inventors have developed a dephosphorization process using a $CaC_2$—$CaF_2$ type flux for an alloy such as high chromium steel which contains a large amount of elements exhibiting extremely high affinity for oxygen and, therefore, rendering dephosphorization of the alloy by oxidation refining method difficult. This process effects the dephosphorization as shown by the formula, $3Ca+2P \rightarrow Ca_3P_2$, by utilizing Ca which is formed by the reaction of the formula, $CaC_2 \rightarrow Ca+2\underline{C}$. For the treatment to be realized, therefore, it is necessary that the reaction of the latter formula should be promoted, i.e. the molten metal should not be saturated with carbon and should possess an ability to melt in free carbon. When the product formed in the stage of smelting reduction is saturated with carbon, the dephosphorization with $CaC_2$—$CaF_2$ flux must be preceded by the decarburization which is to be performed after completion of the smelting reduction and subsequent removal of slag, making the whole operation highly complicate. In contrast, when the molten metal not saturated with carbon is directly obtained during the stage of smelting reduction, dephosphorization and highly exacting desulfurization can be rather easily accomplished by keeping the ladle for receiving the tapped molten metal with a lid thereby shielding the molten metal against the ambient air and adding a flux consisting of 10 to 25 kg of $CaC_2$ and 5 to 10 kg of $CaF_2$ each per ton to the fresh melt.

For the aforementioned dephosphorization to be carried through, the alloy obtained by the smelting reduction of chromium oxide such as chromium ore must be in a form not saturated with carbon.

When the metal is desired to be obtained in a form not saturated with carbon, the smelting reduction of chromium oxide becomes particularly difficult for the following reason. In the atmosphere which is oxidative as described above, when the molten metal is to be rendered unsaturated with carbon, while the slag layer is to be maintained in strongly reductive and carbon-saturated state, it is necessary to stabilize the aforesaid nonequilibrium state. This task is extremely difficult to fulfil. It is naturally possible to produce the carbon-unsaturated high-chromium alloy by decarburization of the carbon-saturated high-chromium alloy produced by smelting reduction. This method is not advantageous in the sense that it calls for incorporation of additional steps.

In a process for the production of a high-chromium alloy by the smelting reduction using a chromium oxide-containing raw material, a carbonaceous material such as coke, a flux such as lime, and an oxidizing gas such as oxygen in a converter capable of top and bottom oxygen blowing, the improvement which comprises dividing the entire operation into a first stage and a second stage, i.e. (i) the first stage wherein the carbon content [C%] at the end point of the operation performed under continued supply of a pre-reduced chromium oxide-containing raw material is maintained below the carbon content of the product aimed at and above $0.3 \times$(saturated carbon content, %) by utilizing the condition of slag height exceeding 1.5 m and repressing the contact between the carbonaceous material in the slag and the molten metal and (ii) the second stage wherein the oxygen concentration [$O_2$%] of the gas of the bottom blowing started subsequent to suspension of the supply of the chromium oxide-containing raw material is adjusted to a level satisfying the following formula.

$$[O_2\,\%] \leqq 70 -$$

-continued $$\frac{100\left\{\left(\begin{array}{c}\text{Saturated carbon}\\ \text{content}\\ (\%)\end{array}\right)-\left(\begin{array}{c}\text{Carbon content}\\ \text{of product}\\ (\%)\end{array}\right)\right\}}{[\text{Saturated carbon content } (\%)]}$$

Now, the present invention will be described more specifically below with reference to a working example.

FIG. 11 illustrates a typical set up for working out the present invention.

In the smelting reduction furnace 22, an oxygen-containing gas is blown into the molten metal through the bottom blowing tuyere 23 (with the tuyere formed in a double-tube construction, the outer tube serving to pass propane or argon for the protection of the tuyere and the inner tube to pass oxygen, for example). The gas so blown in through the converter bottom is important in respect that it causes hard stirring of the metal 27 and the formed slag layer 28 and consequently promote the reduction of chromium oxide and it further combust the carbon in the metal to heat the molten metal and maintain the metal at a suitable temperature. Particularly in the present invention, this gas constitutes itself an indispensable means of decarburizing the molten metal and controlling the carbon content to a prescribed level. For the oxygen-containing gas to be blown into the metal, there can be used a double-tube tuyere such that the outer tube will be utilized for blowing a small amount of cooling gas such as hydrocarbon ($C_nH_m$), argon, or $N_2$ to repress possible loss of the tuyere by melting.

The supply of oxygen through the top blowing lance constitutes itself a main means of controlling the condition of heat generation within the smelting reduction converter.

Between the rotary kiln and the smelting reduction converter, a pellet storage tank may be installed, when necessary, as a buffer for matching the two converters. The rotary kiln may be operated discontinuously in accordance with the supply pattern of raw material to be required for the sake of the smelting reduction converter. Otherwise, there may be adopted a setup having two smelting reduction converters installed for one rotary kiln so that the operating cycles of the two smelting reduction converters will be staggered and, consequently, the combined supply of raw material to the two converters will be carried out continuously. In this setup, the storage tank may be decreased in size or totally eliminated.

Operation

The apparatus constructed as described above is operated as follows.

The rotary kiln is charged with chromium ore pellets incorporating carbon component and lumpy coke. To the raw material, mainly the hot gas emanating from the smelting reduction converter and optionally heavy oil or some other fuel are added as heat source. Air or oxygen-enriched air is supplied through the air nozzle 42 or the air port 35 to permit control of the combustion so that the highest temperature region within the kiln will remain above 1,400° C., the level necessary for the promotion of the reduction of chromium. The carbonaceous material required by the smelting reduction converter is desired to be supplied wholly through the rotary kiln, except for only a small part of the carbonaceous material to be used for the purpose of adjustment. This is because the reoxidation of pellets within the high temperature region is prevented and the ratio of reduction of the pellets supplied to the smelting reduction converter is maintained at a high level when the amount of carbonaceous material within the kiln is increased and further because the carbonaceous material itself is given a chance of being preheated and thus allowed to contribute to improving the heat balance of the smelting reduction converter. Where the carbonaceous material to be supplied to the kiln is so much that the CO concentration of the gas at the outlet of the kiln is intolerably high, part of the carbonaceous material may be separately supplied through a scoop feeder joined to the kiln halfway along the length thereof.

As the flux, lime and optionally quartzite or slag containing CaO and $SiO_2$ (such as the slag occurring in the stage of stainless steel production) as suitably selected to meet the condition of the composition of formed slag are added to the smelting reduction converter. This flux is added substantially proportionately to the amount of chromium pellets being added or, in due consideration of the time required for slag formation, added slightly advanced relative to the amount of chromium pellets being added. The flux may be fed straight through the hopper 26 to the smelting reduction converter or passed through the rotary kiln and forwarded thence, in a preheated state, to the converter.

To start the smelting reduction converter operating, an iron type or an iron-chromium type molten metal obtained from some other smelting furnace is charged thereto or coke and mold pig iron or solid ferrochromium are supplied thereto and oxygen is blown to melt the metal and use the molten metal as starting melt. To start the second and subsequent cycles of heating, at least 80% of the slag and about two thirds of the high-chromium molten metal formed in the preceding cycle are tapped and about one third of the rated amount of molten metal is left standing in the converter as the starting melt for the next cycle.

First stage of smelting reduction

The aforementioned starting melt is kept stirred by blowing an oxygen-containing gas therein through the bottom blowing tuyere 23 and, at the same time, oxygen is blown in through the top blowing lance 24 and prereduced chromium pellets, carbonaceous material such as coke, and flux are supplied from the rotary kiln. As the result, oxidation of the carbonaceous material with evolution of heat ($C \rightarrow CO$ or $CO_2$), reduction of the oxide of chromium or iron with carbon (originating in solid carbonaceous material or the carbon dissolved in the metal), and formation of slag with MgO, $SiO_2$, $Al_2O_3$ components present in the chromium pellets, ash present in the carbonaceous material, and CaO added as the flux (possibly in conjunction with $SiO_2$) proceed.

As the addition of raw materials is continued, the amounts of molten slag and molten metal grow. In the meantime, the rate of the feeding of raw materials, the rate of the top oxygen blowing, the height of the lance, etc. are regulated so that the metal temperature remains above the solidifying point and below 1,650° C. The maintenance of the metal temperature above the solidifying point is for the purpose of preventing the bottom blowing tuyere essential for the performance of the present invention from blockade. Under the hard stirring which is also essential for the present invention, the temperature difference between the metal and the slag is small so that possible erosion of the lining by the slag can be repressed by controlling the metal temperature below 1,650° C. The temperature of the molten metal may be measured by dipping the thermocouple at intervals of several minutes. Otherwise, it may be estimate with fair accuracy by continuously measuring the pressure inside the bottom blowing tuyere. This estimation is based on the phenomenon that the deposit (solidified metal and chromium oxides) at the tip of the tuyere increases and the pressure inside the tuyere is proportionately increased when the metal temperature falls. The relation between the inner pressure of the tuyere and the metal temperature is substantially fixed when the tuyere condition, the bottom oxygen blowing condition, and the metal composition are determined. Once this relation is found, the metal temperature can be estimated from the found value of the inner pressure of the tuyere in accordance with the formula of that relation.

The total amount of oxygen gas to be supplied to the smelting reduction converter is determined based on the compositions of the various raw materials supplied, the temperature condition, the $CO/CO_2$ ratio of the waste gas (which can be freely fixed when the value of this ratio $CO/CO_2$ exceeds 0.4). The rate of oxygen blowing per unit time can be found by dividing the total amount of oxygen gas required by the number of hours in the first stage of the smelting reduction. By deducting part of the amount of gas to be used for the bottom blowing as described more fully afterward, the rate of top oxygen blowing can be found. The fixation of the $CO/CO_2$ ratio of the waste gas is accomplished by adjusting the shape of the nozzle of the blowing lance and the height of the lance.

For this invention, the bottom blown gas is important as the principal source of force required in stirring to the slag and the metal. For increasing the rate of the reduction of the oxide, the bottom blown gas serves to uniformize the temperature of the molten metal and that of the slag to the fullest possible extent and minimize the local rise of temperature which is a cause for damage to the lining. In the present invention, an oxygen-containing gas is used for the bottom blowing, because this gas fulfils the role of stirring and, at the same time, decarburizing the metal. As the amount of the molten slag in the furnace increases and the height of the molten slag layer (which is expressed by the difference between the height of the melt in the converter and the height of the stationary surface of the molten metal) consequently exceeds 1.5 m, the slag represses otherwise possible contact between the carbonaceous material supplied into the smelting reduction converter (although a certain proportion of the carbonaceous material is included in the slag by stirring, the majority thereof is distributed in the relatively upper portion of the molten slag because the specific gravity thereof is smaller than the molten slag) and the molten metal or the splash rising from the molten metal and substantially precludes direct passage of carbon from the carbonaceous material to the molten metal.

When the condition mentioned above is assumed and then the operation of the first stage of smelting reduction is continued, the chromium pellets supplied are reduced and the Cr-Fe alloy passing into the molten metal are substantially saturated with carbon and supply of carbon to the molten metal is consequently effected. In this case, when the oxygen gas is blown through the bottom in an amount greater than is required for oxidizing the supplied carbon to CO, the molten metal can be decarburized, making it possible to adjust the carbon concentration in the molten metal to a prescribed level at the end point of the first stage of smelting reduction. Even in the presence of free carbonaceous material required for promoting the reduction of the slag, the direct contact between the molten metal and the free carbonaceous material can be precluded and the carbon activity of the molten metal can be controlled below 1 despite the molten slag's carbon activity 1 by selecting the amount of slag formed and the shape of the reaction vessel thereby maintaining the slag height above 1.5 m.

FIG. 22 shows the relation between the unsaturation degree of carbon of the metal at the end point of the first stage of smelting reduction $$\left(\text{defined as } \frac{\text{saturated carbon (\%)} - \text{metal C (\%)}}{\text{saturated carbon (\%)}}\right)$$

and the ratio (Cr%)/[Cr%] (wherein (Cr%) denotes the chromium content of the slag and [Cr%] the chromium content of the metal). The metal components (Cr and Fe) are reoxidized when a gas having a high oxygen content ($[O_2] > 70\%$) is blowin in through the bottom so much as to unsaturate the carbon in the molten metal. During the first stage of smelting reduction, however, the reoxidation of the molten metal, if suffered to proceed to some extent, does not manifest its adverse effect conspicuously because supply of the raw material containing the oxides of chromium and iron (partially reduced chromium pellets) into the converter is continuing. Thus, the decarburization can be effected to a certain level of [C%] (in the case of the data of FIG. 22, to below 0.7 of the unsaturation degree of carbon, namely [C%] above 0.3 [saturated carbon content (%)]). When the unsaturation of carbon is tried to be promoted further than this extent (viz. to lower the metal C% further), the reoxidation of the molten metal with the bottom blown gas proceeds excessively and particularly the total iron concentration (T.Fe%) increases abruptly to give an adverse effect upon the lining. During the second stage of smelting reduction, the rate of decarburization is lowered because the partial oxygen pressure of the bottom blown gas is limited. For the present invention, therefore, the metal C% at the end point of the first stage of smelting reduction must be kept below the C% of the product aimed at. To be specific, the metal [C%] at the end point of the first stage of smelting reduction must be lower than the C% of the product aimed at and higher than 0.3×[saturated carbon content (%)]. It is apparent from this requirement that this invention does not suit the production of carbon unsaturated molten metal below 0.3×[saturated carbon content (%)].

Second stage of smelting reduction

When the supply of the prescribed amount of chromium oxide-containing raw material (partially reduced chromium pellets) is completed, the operation shifts to the second stage of smelting reduction which is aimed at effecting finishing reduction for the purpose of lowering the chromium content of the slag to a prescribed level. During this stage, it is essential to promote the reduction of chromium without exerting any excessive load on the lining and to lower the chromium content of the slag to the prescribed level as quickly as possible by suspending the supply of pellets, continuing the top oxygen blowing to permit control of the temperature, and regulating the amount of free carbonaceous material as a reducing agent.

First, the metal temperature is controlled above the temperature for start of solidification and below 1,650° C. by the same procedure for the same reason as in the first stage of smelting reduction. The temperature is controlled by the conditions of the top oxygen blowing (such as the rate of oxygen blowing and the height of the lance).

To ensure efficient promotion of the reduction of chromium in the slag, it is necessary to repress substantially the reoxidization of the components of molten metal by the bottom blown gas. Thus, the highest possible oxygen content of the bottom blown gas depends on [Cr%] and [C%] of the product aimed at and satisfies the empirical relation illustrated in FIG. 23. To be specific, the oxygen content of the bottom blown gas, [$O_2$ (%)], must satisfy the relation of the following formula.

$$[O_2\,\%] \leqq 70 - \frac{100\left\{\left(\begin{array}{c}\text{Saturated carbon}\\ \text{content}\\ (\%)\end{array}\right) - \left(\begin{array}{c}\text{Carbon content}\\ \text{of product}\\ (\%)\end{array}\right)\right\}}{[\text{Saturated carbon content } (\%)]}$$

The reaction of reduction (the decrease of the chromium content of the slag) proceeds by using mainly the carbonaceous material as a reducing agent and relying, as the energy therefor, upon the heat generated preponderantly by the partial combustion of the carbonaceous material with the top blown oxygen. For the promotion of the reduction, therefore, the presence of free carbonaceous material in the slag is an essential prerequisite. For improving the rate of reduction, the amount of the free carbonaceous material is desired to be as large as permissible. The amount of the free carbonaceous material is approximately the difference resulting from the deduction of the amount of carbon released from the converter in the form of CO or $CO_2$ from the amount of carbon present in the carbonaceous material supplied to the smelting reduction converter. In actuality, about 20 to 150 kg of free carbonaceous material is used per ton of the molten slag. The chromium oxide in the slag is reduced to form a molten Cr-Fe-C alloy (with the C component in the amount substantially approximating the saturated level) and passes in that form from the slag phase to the molten metal. In consequence of this passage of the molten Cr-Fe-C alloy, supply of carbon to the molten metal takes place. As already described, the molten metal can be decarburized to the extent corresponding to the carbon so supplied when the bottom blown gas is vested with oxidizing ability within the limit imposed for precluding the molten metal from reoxidization.

To heighten the rate of the reduction (vis. the rate of the decrease of the total chromium content of the slag), the slag composition is desired to satisfy the conditions of the following formulas.

$$\frac{(CaO\,\%) + 1.39\,(MgO\,\%)}{(SiO_2\,\%) + 1.18\,(Al_2O_3\,\%)} = 0.7 \text{ to } 1.5$$

and $$(Al_2O_3\,\%) \leqq 25\%$$

Where these conditions are satisfied, the chromium content of the slag can be lowered to the prescribed level by continuing the treatment for a period required. By so doing, it is possible to lower the total chromium content of the slag to even below 0.5%.

When the chromium content of the slag is lowered to the prescribed level and the carbon content of the molten metal to the level expected of the product, the slag is discharged. Then, the molten metal is tapped. In that case, about one third of the formed metal is left standing in the converter to serve as starting melt in the subsequent cycle.

The withdrawn molten metal may be solidified and subsequently crushed into a finished product similarly to the ordinary ferrochromium. Optionally, it may be transferred directly in a molten state to the steelmaking plant and used there for the purpose of lowering the cost of production of stainless steel through the effective use of the sensible heat possessed by the molten metal. After tapping from the converter, the molten metal may be treated in the ladle as described below for the removal of impurities. The discharged slag can be left solidifying or quenched with forced streams of water, optionally crushed, subjected to magnetic separation for recovery of metal particles, and then put to use suitably. It finds utility as material for ground reclamation, material for road bed, and soil conditioner.

EXAMPLE

Two top and bottom blowing converters each of a rated capacity (amount of molten metal immediately before tapping) for 50 tons of molten metal were used as reactors and semicontinuously operated by using partially reduced chromium pellets and following a fixed schedule of tapping two thirds (about 33 tons) of the product ferrochromium and leaving about one third thereof. The smelting reduction converter was provided on the bottom thereof four bottom blowing tuyeres (double-tube construction having an inside diameter of 20 mm). During the first stage of smelting reduction, the inner tube was used for passing pure oxygen and the outer tube for passing propane gas as protective gas. During the second stage of smelting reduction, both the inner and outer tubes were used for passing argon gas. The top blowing lance was provided with a total of seven orifices (one central orifice and six circumferentially spaced orifices).

Chromium ore as the main raw material for smelting reduction was pulverized in conjunction with coke, pelletized, dried, charged in a rotary kiln, and subjected to pre-reduction and preheating with the hot gas from the smelting reduction converter as the heat source. Of the carbonaceous material to be supplied to the smelting reduction converter, 80% was placed as coke in the rotary kiln to serve the purpose of improving the ratio of reduction of the partially reduced pellets and preheating the carbonaceous material being supplied to the smelting reduction converter.

The average composition and temperature of the partially reduced chromium pellets supplied to the smelting reduction converter were as shown below.

Total Cr: 35%, Total Fe: 23%, ratio of Cr reduction: 66%, ratio of iron reduction: 92%, MgO: 10%, $Al_2O_3$: 10%, $SiO_2$: 9%, temperature: 1,300° C. First stage of smelting reduction:

To 17 tons of the starting melt, an oxygen-containing gas was introduced by top blowing and preheated prereduced pellets, carbonaceous material, and lime were supplied.

The oxygen introduced at a top blowing rate of 12,000 $Nm^3/hr$ and a bottom blowing rate of 2,000$Nm^3/hr \times 4$. The rate of introduction of the pre-reduced pellets was adjusted so that the temperature of the molten metal phase would be controlled between 1,580° C. and 1,630° C.

Over a period of 45 minutes, 64 tons of the partially reduced pellets, 20 tons of carbonaceous material, and 7.0 tons of lime were charged to the converter. Within 16 minutes of starting the introduction of the pellets, the slag height exceeded 1.5 m. By continuing the treatment for 30 minutes thence, the [C (%)] at the end point of the first stage of smelting reduction was brought to 4.6% [Cr (%)]=50% (at which point the saturated carbon content was 8.8%). The slag composition at this time was CaO: 25%, $SiO_2$: 26%, MgO: 20%, $Al_2O_3$: 20%, Total Cr: 6.8%, and Total Fe: 1.1%.

Second stage of smelting reduction

The supply of the partially reduced pellets was discontinued and the carbonaceous material was charged through the carbonaceous material supply hopper into the smelting reduction converter at intervals of three minutes in a unit amount of 100 kg. Both the inner and outer tubes of the tuyere were used for passing argon gas (inner tube 700 $Nm^3/hr \times 4$ and outer tube 300 $Nm^3/hr \times 4$). Within 15 minutes of starting the second stage, the slag composition was CaO: 28%, $SiO_2$: 28%, MgO: 20%, $Al_2O_3$: 20%, Total Cr: 0.6%, and Total Fe: 0.7% and the metal composition was Cr: 54%, C: 4.5% (the saturated carbon content was 9.1%), Si: 0.1%, S: 0.025%, P: 0.039%, and Fe: balance.

After discharge of 90% of the slag and tapping of 66% of the metal, the aforementioned procedure was repeated.

By the process described above, a carbon-unsaturated high-chromium alloy could be directly produced by smelting reduction without lowering the yield of chromium.

From the foregoing description of a working example, it is noted that the present invention enjoys the following merits.

(i) When the high-chromium alloy is adopted as an alloy source for stainless steel, for example, the low carbon content immediately results in alleviation of the load of decarburization during the course of steelmaking. Particularly when the formed high-chromium alloy can be transported in its molten stage to the stage of steelmaking, since mixture of this molten alloy with a low-carbon molten steel in proportions calculated to give the resultant blend a Fe/Cr ratio proper to stainless steel permits the carbon content of the blend to fall below 2%, this blend can be forwarded directly to the stage of finishing decarburization using bottom Ar—$O_2$ blowing or vacuum oxygen blowing. When the high-chromium alloy is produced as saturated with carbon as usual heretofore, since the degree of decarburization required for the sake of the steelmaking process is large, it is generally subjected to primary decarburization before it is forwarded to the stage of finishing decarburization. Thus, the high-chromium alloy of the present invention permits omission of part of the conventional process.

(ii) When the high-chromium alloy is produced in a state not saturated with carbon, the temperature at which the alloy begins to solidify is lowered. If, during the operation of the smelting reduction converter, the temperature of the melt is lowered, the trouble usually caused at the bottom blowing tuyere will not occur readily and the operation will be carried out safely. The fact that the temperature of the melt is lowered means that the possible damage to the lining is mitigated so much.

(iii) When the production of a ferrous type alloy is switched from the conventional electric furnace process to the smelting reduction process which has no use for electric power, the amount of the carbonaceous material to be used is increased and, as the result, the phosphorus content of the product is increased. This fact constitutes a problem on the part of ferrochromium which is not easily dephosphorized by the ordinary oxidative smelting method. The present invention does not entail any problem of this nature.

As another method for the production of carbon-unsaturated chromium alloy from the alloy produced by the process of smelting reduction of chromium oxide such as chromium ore, the inventors have created the following process.

This is a process for the production of carbon-unsaturated high-chromium molten metal by a procedure of charging chromium ore or externally pre-reduced chromium ore and carbonaceous material in a converter capable of hard stirring of molten metal by gas blowing and introducing oxygen therein by blowing, wherein high-chromium molten metal produced consequently has its carbon component in the unsaturated state by satisfying the condition, slag weight/metal weight $\geqq 0.2$ and, at the same time, adding scraps thereto to be melted therein.

Now, the present invention will be described in detail below.

Heretofore, ferrochromium which is a main chromium source for stainless steel has been produced by charging chromium ore or partially reduced chromium ore in conjunction with a carbonaceous material such as coke in a low-shaft type electric furnace and effecting smelting reduction of the oxides of iron and chromium. Owing to the arc heating conducted in the presence of free carbonaceous material, the formed metal is generally saturated with carbon. Scraps of stainless steel which are secondary source for chromium are charged in conjunction with ferrochromium and some iron source (pig iron or ordinary steel scraps) in a steelmaking furnace and melted and blended to produce crude molten stainless steel (which is converted into regular molten stainless steel by subjected to finishing decarburization, deoxidation, and adjustment of composition).

This conventional process encounters the following two major problems.

(i) Since expensive electric energy is used for the reduction of chromium oxide, the cost of production of ferrochromium is high.

(ii) The cost of melting stainless steel scraps during the stage of steelmaking is high. When the steelmaking is effected by the use of an electric furnace, the cost of energy is high despite the absence of any upper limit to the amount of scraps to be used. When the production is carried out by the use of a converter, the blending ratio of scraps under ordinary operating conditions is limited to a low level. If the scraps are used in a greater blending ratio, there must be inevitably adopted an expensive method which comprises adding a Si alloy to the scraps, blowing the resultant mixture with oxygen, and utilizing the heat consequently generated, for example.

One method available for the solution of the problem of (i) comprises combusting carbonaceous material such as coke with oxygen ($C \rightarrow CO$ or $CO_2$) and utilizing the heat of this combustion as the energy for the reduction of the oxide of chromium. This method will be referred to hereinafter as the smelting reduction method. Since this process uses more carbonaceous material (mainly coke) than the electric furnace method, the high-chromium alloy obtained thereby as a product suffers from an increased phosphorus input due to the impurities entrained by the carbonaceous material. This increased phosphorus input directly results in an increased phosphoric content in the produced high-chromium alloy. For example, the product of the smelting reduction method has a phosphoric content of 0.04% of more, whereas the product of the conventional electric furnace method has a phosphorus content of 0.03%. Unlike the ordinary carbon-containing molten metal (molten pig iron or molten steel), the high-chromium molten metal can not be dephosphorized by the ordinary oxidative smelting method. The high-chromium alloy having a higher phosphorus content than the conventional countertype offers no problem when used as a chromium source for stainless steel.

One important requirement for the smelting reduction method is expected to fulfil as a process is to decrease the unit consumption of the lining. It is temperature that affects the unit consumption of the lining most. Thus, the temperature is desired to be lowered as much as possible. When the product is not saturated with carbon, the melting point thereof is high (about 1,580° C.) and the internal temperature of the furnace can not be lowered below this level. When the produced molten metal is directly put to use in the production of stainless steel with a view to effective use of the sensitive heat possessed by this molten metal, since the molten metal has a high melting point and high viscosity, it tends to adhere to the container used for its transfer and cause handling problems of similar nature.

The reaction of reduction of the chromium oxide in the slag occurs preponderantly in the interface between the molten slag and the carbonaceous material or metal particles in the slag. Although the molten metal is not ineffective as a site for the reduction, the metal particles in the slag contributes more to the reduction owing to their decisively larger surface area. Thus, the rate of the reduction increases in proportion as the temperature rises, the intensity of stirring of the slag increases, the amount of the free carbonaceous material in the slag increases, the quantity of metal particles in the slag increases, and the Cr% of the metal particles decreases.

If the amount of the carbonaceous material and the composition and the amount of metal particles in the slag are limited, elevation of the temperature is an inevitable requirement for the purpose of obtaining the fixed rate of reduction.

Production of ferrochromium by smelting reduction offers no solution at all to the problem of (ii).

In view of the true status of affairs described above, this invention aims to provide a process for the production of carbon-unsaturated high-chromium molten metal, which solves the problems encountered in the adoption of the smelting reduction method for the production of high-chromium alloy as a chromium source for stainless steel, permits efficient melting of scraps, and lowers the cost of stainless steel production.

Specifically, the present invention resides in a process for the production of carbon-unsaturated high-chromium molten metal by a procedure of charging chromium ore or externally pre-reduced chromium ore and carbonaceous material in a converter capable of hard stirring of molten metal by gas blowing and introducing oxygen therein by blowing, wherein high-chromium molten metal consequently produced has its carbon component in the unsaturated state by satisfying the condition, slag weight/metal weight $\geqq 0.2$ and, at the same time, adding scraps thereto to be melted therein.

Now, the present invention will be described in detail below with reference to an embodiment illustrated in FIG. 11.

As already described, the rotary kiln 21 serves to preheat and pre-reduce the carbon-containing pellets produced from chromium ore and powdered coke by utilizing the hot gas emitted from the smelting reduction converter 22. It is one of the most advantageous means of utilizing the sensible heat and the latent heat of the waste gas emanating from the smelting reduction converter 22.

By 26 is denoted a scrap feeding device for feeding scraps to the smelting reduction converter. The smelting reduction converter 22 serves to receive supply of pre-reduced chromium pellets, melt these pellets and, at the same time, promote the reduction of residual chromium and iron components and receive supply of scraps 46 and melt them, with an eventual aim at producing carbon-unsaturated high-chromium molten metal. The reduction converter is designed in the pattern of a converter for the purpose of materializing hard stirring of slag, which is an essential condition for the promotion of the reaction involved.

The setup described above is operated as follows. The description starts from the point at which the slag and about two thirds of the high-chromium molten metal formed in the preceding cycle of heating have been tapped from the furnace and about one third of the rated amount of molten metal is left standing in the converter. Into the molten metal, an oxygen-containing gas is introduced through the bottom blowing tuyere 23 (in a double-tube construction, for example, with the outer tube used for passage of propane gas or argon for the protection of the tuyere and the inner tube for passage of oxygen gas) and oxygen is introduced through the top blowing lance 24 and, at the same time, preheated and pre-reduced chromium pellets, carbonaceous material, and flux (mainly lime) are charged from the rotary kiln 21 into the smelting reduction converter. Consequently, the oxidization of the carbonaceous material with evolution of heat ($C \rightarrow CO$ or $CO_2$), the reduction of carbon (originating in solid carbonaceous material or the carbon dissolved in the metal) and chromium or iron oxide, and the formation of slag by the gangue and the flux proceed. When the weight ratio of slag to metal exceeds 0.3, supply of scraps through the scrap supply device 26 to the furnace interior is started. The pattern of the supply of scraps can be selected in a wide range. From this point until 10 minutes before the metal tapping, the supply is desired to be carried out substantially evenly.

After the prescribed amount of chromium ore or partially reduced pellets has been supplied, the addition of scraps alone is continued and the introduction of oxygen by blowing is effected to give finishing reduction to the chromium component in the slag.

When the chromium content in the slag reaches the prescribed level (such as below 1%), the metal is tapped from the converter. Part of the metal (about one third of the formed metal, for example) is left standing in the converter. Then, the procedure described above is repeated.

The scraps to be used in this operation may be either stainless steel scraps or ordinary steel scraps. In any event, the Cr/Fe weight % in the scraps is lower than that in the chromium ore. The shape of scraps is arbitrary in so far as the device used for the supply of scraps offers no restriction. For the purpose of the present invention, scraps such as are by-produced in cutting or pressing thin steel sheets which have a small bulk specific gravity and are rather hard to melt by the other method are suitable.

When such scraps of relatively small bulk specific gravity are added to the furnace in which the weight ratio of slag/metal is more than 0.3, namely, the amount of slag is notably large as compared with the slag involved in the ordinary steelmaking operation, the heating and melting are carried out as follows. When the scraps enter into the molten slag, they absorb the sensible heat and the solidifying latent heat from the slag while repressing the oxidation with the $CO_2$ in the atmosphere. As they are consequently melted, part of the formed molten drops react with the free carbonaceous material suspended in the slag and give rise to effective sites for the reduction of the chromium oxide (originating in the chromium oxide supplied simultaneously) in the slag. In the absence of such addition of scraps, the metal particles present in the slag are limited to those formed in consequence of the reduction of the oxide and those originating in the splash caused by the stirring of the molten metal. In the presence of this addition of scraps, the amount of metal particles suspended in the slag can be freely increased. Particularly when the scraps to be used have a low Cr content, there is derived an effect of improving the rate of the reduction of chromium oxide by the carbon-containing metal particles (for a fixed specific surface area). The metal particles produced in consequence of the melting of the scraps are such that, although the capacity thereof for the reduction of chromium oxide in the slag is variable with the degree of carbon absorption, they exhibit a chromium-reducing capacity directly proportional to the degree of carbon absorption, undergo decarburization due to the reduction, consequently pass into the molten metal in a state not saturated with carbon, and contribute to lowering the carbon content of the molten metal.

If such scraps are added where the slag/metal weight ratio is below 0.15, the level normal to steelmaking, since the amount of the slag is insufficient, the free carbonaceous material for reduction is urged by stirring into direct contact with the molten metal. Thus, the scraps are incapable of precluding the molten metal from absorbing carbon and contributing to the maintenance of the unsaturation state of carbon.

The unsaturation degree of carbon of the product to be obtained (namely the difference, [saturated carbon content]−[carbon content of product]) can be controlled by the kind and amount of scraps to be used, for amount of oxygen introduced by bottom blowing, etc.

FIG. 25 shows the relation between the amount of carbon in the high-chromium molten metal, the temperature of the molten metal, and the efficiency of smelting of the dephosphorization-desulfurization treatment by the use of a $CaC_2$—$CaF_2$ type flux outside the converter. It is noted from the data that where Cr is 50% and the carbon content is above 4%, the melting temperature decreases and the efficiency of smelting during the treatment with $CaC_2$—$CaF_2$ improves in proportion as the carbon content decreases. (The reaction for dephosphorization requires the formation of Ca due to the reaction, $CaC_2 \rightarrow Ca + 2C$).

In accordance with the present invention, the following peculiar effects can be manifested by combining the smelting reduction of chromium ore or partially reduced chromium ore and the melting of scraps.

(1) Compared with the melting of scraps in the ordinary steelmaking furnace, the melting of scraps by the present invention is quite efficient in respect that the melting can be effected by utilizing the heat of secondary combustion ($CO \rightarrow CO_2$) within the converter and, in the meantime, precluding the scraps from reoxidization. (This effect is owing to the effective utilization of the large amount of slag originating in the gangue components present in the chromium ore.)

(2) The metal particles formed in the slag in consequence of the melting of the scraps can be effectively utilized for promoting the reduction of chromium oxide and, from the standpoint of the rate of reaction, enabling the slag temperature to be lowered.

(3) Owing to the fact that the carbon-unsaturated scraps (generally due to low carbon content), the Cr% of the produced molten metal can be lowered and the melting temperature of the molten metal lowered. Consequently, the metal temperature in the converter can be lowered and, with the effect of (2) as a contributory factor, the operating temperature can be lowered and the load upon the converter-lining can be mitigated. Further, the ease of handling of the molten metal outside the converter (transfer into the ladle for transport) can be enhanced and, optionally, the dephosphorization and desulfurization can be effected by the treatment with $CaC_2$—$CaF_2$ type flux.

The carbon-unsaturated molten metal obtained by this process may be solidified and remelted during the course of steelmaking similarly to the ordinary ferrochromium. Preferably, however, it is directly used in its molten state, optionally with the Cr% adjusted by addition of iron melt, in the production of stainless steel.

Example:

A top and bottom blowing converter having a rated capacity (amount of molten metal immediately before tapping) for 80 tons of molten metal was used as a reactor and semicontinuously operated on a fixed schedule of using partially reduced chromium pellets and stainless steel scraps as the raw material, tapping two thirds (about 54 tons) of formed ferrochromium, and leaving one third of the ferrochromium standing in the converter. The smelting reduction converter was provided on the bottom thereof with four bottom blowing tuyeres (double-tube construction having an inside diameter of 20 mm), with the inner tube used for passage of pure oxygen and the outer tube for passage of propane gas as protective gas. The nozzle of the top blowing lance was provided with a total of seven orifices (one central orifice and six circumferentially spaced orifices).

The chromium ore as the main raw material for the smelting reduction was mixed with coke, pulverized, pelletized, dried, and charged in the rotary kiln and, therein, preheated and pre-reduced by the heat of the hot gas emanating from the smelting reduction converter.

The partially reduced chromium pellets supplied to the smelting reduction converter had the following average composition and temperature.

Total Cr: 36%, Total Fe: 18%, ratio of Cr reduction: 66%, ratio of iron reduction: 92%, MgO: 10%, $Al_2O_3$: 10%, $SiO_2$: 9%, and temperature: 1,000° C.

The carbonaceous material was ordinary lumpy coke having a carbon content of 88% and a particle size of 10 to 70 mm.

The scraps were chromium type stainless steel scraps (average composition of Cr: 17% and C: 0.04%) resulting from the cutting and pressing of steel sheets not more than 1 mm in thickness. They had a bulk specific gravity of 3 to 4.

First stage of smelting reduction

To 26 tons of the residual molten metal (amount of residual slag: about 2 tons), an oxygen-containing gas was introduced by top blowing and preheated, prereduced pellets, carbonaceous material, and lime were substantially continuously supplied.

The introduction of oxygen was effected at a top blowing rate of 9,000 $Nm^3/hr$ and a bottom blowing rate of 800 $Nm^3/hr \times 4$. The rate of supply of the prereduced pellets was adjusted so as to control the temperature of the molten metal between the limits of 1,580° C. and 1,630° C.

Within 15 minutes after starting of the present stage, about 11 tons of the partially reduced chromium pellets were charged and the amount of slag increased to about 7 tons and that of metal to about 29 tons (slag/metal weight ratio 0.24), the introduction of scraps was started. Over the subsequent period of 25 minutes, the amount of scraps so introduced reached a total of 30 tons.

Second stage of smelting reduction

The supply of the partially reduced chromium pellets was discontinued after their total reached 32 tons over a period of 45 minutes. Thereafter, the same pellets were introduced through the carbonaceous material hopper into the smelting reduction converter at intervals of three minutes in a unit amount of 100 kg. The amount of oxygen introduced by bottom blowing was fixed and the amount of oxygen introduced by top blowing was veried to 8,500 $Nm^3/hr$, 4,000 $Nm^3/hr$, and 0 $Nm^3/hr$ at intervals of five minutes to promote the reduction of the chromium component in the slag.

The final slag composition of the smelting reduction converter was CaO: 19%, $SiO_2$: 20%, MgO: 24%, $Al_2O_3$: 22%, Total Cr: 0.9%, and Total Fe: 0.7%.

About 90% of the slag was discharged and then about 60% of the formed metal was tapped. The composition of the metal so tapped was Cr: 34%, Fe: 60%, C: 5.3%, Si: 0.1%, S: 0.020%, and P: 0.034%. The temperature of the metal tapped from the converter was 1,630° C. and the temperature of the metal in the ladle 1,580° C.

By blowing a mixed flux of $CaC_2$ (80%) and $CaF_2$ (20%) into the formed metal (10 kg of flux per ton of metal), there was obtained a metal of the following composition.

Cr: 34%, Fe: 61%, C: 5.8%, Si: 0.2%, S: 0.005%, P: 0.017%.

By mixing this metal with ordinary molten steel, there was obtained crude molten stainless steel, which was subjected to finishing decarburization to afford finished stainless steel.

As described above, this invention permits inexpensive production of carbon-unsaturated high-chromium alloy by combining the smelting reduction of unmodified chromium ore or partially reduced chromium ore and the melting of scraps. This process is effective in inexpensive production of stainless steel. Thus, the present invention makes immense contribution to the industry.

What is claimed is:

1. A process for the smelting reduction of chromium ore or chromium oxide, comprising the step of prereducing said chromium ore or chromium oxide thereby obtaining a partially reduced product and the step of supplying said partially reduced chromium ore or chromium oxide, carbonaceous material, flux and oxidative gas to a top and bottom blowing converter thereby effecting smelting reduction of said partially reduced chromium ore or chromium oxide, wherein said step for the smelting reduction of chromium ore or chromium oxide is divided into two stages, i.e. the first stage for supplying said partially reduced chromium ore or chromium oxide, in conjunction with said carbonaceous material and said flux, into said top and bottom blowing converter, blowing said oxidative gas through a top blowing lance and blowing said oxidative gas and inactive gas, through a bottom blowing tuyere into a molten metal formed in said converter and, in the meantime, keeping the temperature of said molten metal below 1,650° C. and controlling the amounts of the materials supplied through said bottom blowing tuyere into said molten metal so that the ratio of the volume of the gas generated by said materials to the total weight of said molten metal and slag will fall in the range of 100 to 2,500 [Nl/min.t] and the second stage for discontinuing the supply of the materials including said partially reduced chromium ore or chromium oxide, keeping the temperature of said molten metal below 1,650° C., controlling the amounts of said materials supplied through said bottom blowing tuyere into said molten metal so that the ratio of the volume of the gas generated by said materials to the total weight of said molten metal and slag will fall in the range of 100 to 1,800 [Nl/min.t], supplying said carbonaceous material so as to give free carbonaceous material in an amount, $C_F$, satisfying the following formula:

$$\frac{C_F}{\text{Amount of slag}} \geqq 20 \text{ kg/t}$$

wherein $C_F = W_c - 0.54\,[(\bar{a}+\bar{b})/100]V$, $W_c$ standing for the accumulative value (kg) of the carbon content of the carbonaceous material supplied, $\bar{a}$ and $\bar{b}$ each of the integral averages of CO% and $CO_2$% in the waste gas composition, and V for the flow volume of the waste gas ($Nm^3$), and supplying CaO and other substances so as to give a slag composition satisfying the following formulas $$\frac{(\text{CaO }\%) + 1.39\,(\text{MgO }\%)}{(\text{SiO}_2\,\%) + 1.18\,(\text{Al}_2\text{O}_3\,\%)} = 0.7 \text{ to } 1.5$$

$$(\%\ \text{Al}_2\text{O}_3) \leqq 25\%.$$

2. A process according to claim 1, wherein the amount of said slag in said top and bottom blowing converter during the stage of said smelting reduction of said partially reduced chromium ore or chromium oxide is controlled to satisfy the formula, slag weight/molten metal weight≧0.2, a chromium oxide-containing substance produced during the course of production of stainless steel is supplied, as part of the raw materials, in conjunction with said carbonaceous material to said top and bottom blowing converter and oxygen is blown therein to recover chromium from said chromium oxide-containing substance.

3. A process according to claim 1, wherein the reduction in said top and bottom blowing converter of said partially reduced chromium ore or chromium oxide is promoted by blowing part of iron oxide-containing raw material in powdery state into said molten slag through said top blowing lance and/or throwing scraps of a bulk specific gravity of not more than 5 downwardly into said molten slag thereby increasing the number of carbon-containing metal particles present in said molten slag.

4. A process according to claim 1, wherein carbon-unsaturated high-chromium alloy is produced by blowing an oxygen-containing gas through a bottom blowing tuyere into the molten metal so that the C% of the molten metal at the end point of said first stage of smelting reduction will not exceed the C% of the product aimed at but exceed 0.3×(saturated carbon content) and the oxygen content ($O_2$ (%) of the gas supplied through the bottom blowing tuyere during the second stage of smelting reduction is controlled so as to satisfy the following formula $O_2\ \% \leqq 70 -$ -continued $$\frac{100\left\{\left(\begin{array}{c}\text{Saturated carbon}\\ \text{content}\\ (\%)\end{array}\right) - \left(\begin{array}{c}\text{Carbon content}\\ \text{of product}\\ (\%)\end{array}\right)\right\}}{\text{Saturated carbon content } (\%)}$$

5. A process according to claim 1, wherein carbon-unsaturated high-chromium alloy is produced by controlling the amount of slag in said top and bottom blowing converter so as to satisfy the formula, slag weight/molten metal weight≧0.2, and adding scraps to the molten metal to be melted therein so that the [C (%)] of the molten metal at the end point of said first stage of smelting reduction will not exceed the C% of the product aimed at but exceed 0.3×(saturated carbon content).

6. A high-chromium alloy of a silicon content of not more than 0.5%, obtained by the process of claim 1.

7. A slag of a composition satisfying the following formulas:

$$\frac{(CaO\ \%) + 1.39\ (MgO\ \%)}{(SiO_2\ \%) + 1.18\ (Al_2O_3\ \%)} = 0.7 \text{ to } 1.5$$

$$(\%\ Al_2O_3) = 17 \text{ to } 25\%.$$

obtained by the process of claim 1, having a chromium content of not more than 1.0%, and useful as earth construction material or soil conditioner.

8. A process according to claim 1 wherein said oxidative gas blown through said top blowing lance is blown in conjunction with a powdered carbonaceous material.

* * * * *